US008447212B2

(12) United States Patent
Funamoto et al.

(10) Patent No.: US 8,447,212 B2
(45) Date of Patent: May 21, 2013

(54) IMAGE FORMING APPARATUS

(75) Inventors: Noriaki Funamoto, Tokyo (JP); Yasuhisa Ehara, Kanagawa (JP); Tetsuji Nishikawa, Tokyo (JP); Yasuhiro Maehata, Kanagawa (JP); Jun Yasuda, Chiba (JP)

(73) Assignee: Ricoh Company, Ltd., Tokyo (JP)

( * ) Notice: Subject to any disclaimer, the term of this patent is extended or adjusted under 35 U.S.C. 154(b) by 238 days.

(21) Appl. No.: 12/805,380

(22) Filed: Jul. 28, 2010

(65) Prior Publication Data

US 2011/0044724 A1 Feb. 24, 2011

(30) Foreign Application Priority Data

Aug. 24, 2009 (JP) ..... 2009-192799

(51) Int. Cl.
*G03G 15/00* (2006.01)

(52) U.S. Cl.
USPC ..... 399/167; 399/164

(58) Field of Classification Search
USPC ..... 399/164, 167
See application file for complete search history.

(56) References Cited

U.S. PATENT DOCUMENTS

| | | | | |
|---|---|---|---|---|
| 6,453,139 | B2 * | 9/2002 | Sasame et al. | 399/167 |
| 6,889,022 | B2 | 5/2005 | Ehara et al. | |
| 6,898,400 | B2 | 5/2005 | Ehara | |
| 7,013,102 | B2 | 3/2006 | Ehara | |
| 7,054,585 | B2 * | 5/2006 | Sasamoto et al. | 399/299 |
| 7,162,185 | B2 | 1/2007 | Ehara | |
| 7,206,537 | B2 | 4/2007 | Funamoto et al. | |
| 7,215,907 | B2 | 5/2007 | Fukuchi et al. | |
| 7,352,978 | B2 | 4/2008 | Ebara et al. | |
| 7,366,431 | B2 | 4/2008 | Ehara et al. | |
| 7,369,795 | B2 | 5/2008 | Funamoto et al. | |
| 7,373,097 | B2 | 5/2008 | Ehara | |
| 7,532,842 | B2 | 5/2009 | Handa et al. | |
| 7,536,143 | B2 | 5/2009 | Funamoto | |
| 7,587,157 | B2 | 9/2009 | Matsuda et al. | |
| 7,603,061 | B2 | 10/2009 | Ebara et al. | |
| 7,606,505 | B2 | 10/2009 | Kikuchi et al. | |
| 7,630,657 | B2 | 12/2009 | Ehara et al. | |
| 7,653,332 | B2 | 1/2010 | Ehara et al. | |
| 7,693,468 | B2 | 4/2010 | Ehara et al. | |
| 7,697,867 | B2 | 4/2010 | Ehara et al. | |

(Continued)

FOREIGN PATENT DOCUMENTS

| | | |
|---|---|---|
| JP | 2000-172125 | 6/2000 |
| JP | 2001083762 A | 3/2001 |

(Continued)

*Primary Examiner* — Walter L Lindsay, Jr.
*Assistant Examiner* — Roy Y Yi
(74) *Attorney, Agent, or Firm* — Harness, Dickey & Pierce P.L.C.

(57) ABSTRACT

An image forming apparatus includes an endless belt member; a drive unit moving the endless belt member; a first detecting unit detecting a rotating speed of the drive unit; a second detecting unit detecting an endless transport speed of the endless belt member; and a control unit controlling the rotating speed of the drive unit based on a first detection signal from the first detecting unit or a second detection signal from the second detecting unit selectively depending on a selection condition. Upon selection of the first detection signal in accordance with the selection condition, the control unit corrects the rotating speed of the drive unit using the second detection signal such that an average value of the endless transport speed of the endless belt member approaches a target average value.

19 Claims, 12 Drawing Sheets

U.S. PATENT DOCUMENTS

| | | | | |
|---|---|---|---|---|
| 7,702,252 | B2 | 4/2010 | Maehata et al. | |
| 7,706,723 | B2 | 4/2010 | Ishida et al. | |
| 7,729,024 | B2 | 6/2010 | Kobayashi et al. | |
| 2003/0002887 | A1* | 1/2003 | Imaizumi et al. | 399/167 |
| 2003/0152402 | A1 | 8/2003 | Ehara et al. | |
| 2004/0009011 | A1 | 1/2004 | Ehara | |
| 2004/0126137 | A1 | 7/2004 | Ehara | |
| 2005/0058470 | A1 | 3/2005 | Funamoto et al. | |
| 2005/0084293 | A1 | 4/2005 | Fukuchi et al. | |
| 2006/0039722 | A1 | 2/2006 | Ehara | |
| 2006/0056865 | A1 | 3/2006 | Ehara et al. | |
| 2006/0056868 | A1 | 3/2006 | Ebara et al. | |
| 2006/0165422 | A1 | 7/2006 | Kikuchi et al. | |
| 2006/0182465 | A1 | 8/2006 | Funamoto et al. | |
| 2006/0210325 | A1 | 9/2006 | Funamoto | |
| 2007/0097465 | A1 | 5/2007 | Kobayashi et al. | |
| 2007/0110477 | A1 | 5/2007 | Handa et al. | |
| 2007/0122172 | A1 | 5/2007 | Ebara et al. | |
| 2007/0140736 | A1 | 6/2007 | Ehara et al. | |
| 2007/0166075 | A1 | 7/2007 | Funamoto et al. | |
| 2007/0172257 | A1 | 7/2007 | Matsuda et al. | |
| 2007/0196132 | A1 | 8/2007 | Kobayashi et al. | |
| 2007/0212109 | A1 | 9/2007 | Ebara et al. | |
| 2007/0253736 | A1 | 11/2007 | Ehara et al. | |
| 2007/0258729 | A1 | 11/2007 | Ehara et al. | |
| 2007/0274746 | A1 | 11/2007 | Ehara et al. | |
| 2007/0297820 | A1* | 12/2007 | Shirakata | 399/44 |
| 2008/0069604 | A1 | 3/2008 | Ebara et al. | |
| 2008/0069635 | A1 | 3/2008 | Maehata et al. | |
| 2008/0089713 | A1 | 4/2008 | Ishida et al. | |
| 2008/0124152 | A1 | 5/2008 | Nishikawa et al. | |
| 2008/0131168 | A1 | 6/2008 | Ehara et al. | |
| 2008/0166153 | A1 | 7/2008 | Ehara et al. | |
| 2008/0213000 | A1 | 9/2008 | Funamoto et al. | |
| 2008/0240754 | A1 | 10/2008 | Kobayashi et al. | |
| 2008/0260420 | A1 | 10/2008 | Maehata et al. | |
| 2008/0282839 | A1 | 11/2008 | Suzuki et al. | |
| 2008/0298856 | A1* | 12/2008 | Koike | 399/302 |
| 2009/0074506 | A1 | 3/2009 | Sugiyama et al. | |
| 2009/0123197 | A1* | 5/2009 | Okumura et al. | 399/301 |
| 2009/0238588 | A1 | 9/2009 | Matsuda et al. | |
| 2009/0317109 | A1 | 12/2009 | Ehara et al. | |
| 2010/0183322 | A1 | 7/2010 | Funamoto et al. | |
| 2010/0226676 | A1 | 9/2010 | Funamoto et al. | |

FOREIGN PATENT DOCUMENTS

| | | | |
|---|---|---|---|
| JP | 2004220006 | A | 8/2004 |
| JP | 2005115339 | A | 4/2005 |
| JP | 2006184601 | A | 7/2006 |
| JP | 2006209042 | A | 8/2006 |
| JP | 2006259173 | A | 9/2006 |
| JP | 2006-323422 | | 11/2006 |
| JP | 2006316985 | A | 11/2006 |

* cited by examiner

IMAGE FORMING APPARATUS

BACKGROUND OF THE INVENTION

1. Field of the Invention

The present invention generally relates to image forming apparatuses capable of feedback-controlling the transport speed of an endless belt member.

2. Description of the Related Art

In the field of image forming apparatuses such as copy machines, printers, and facsimile machines, there is an increasing need for the capability to produce high-quality color images as well as increasing the speed of the image formation process. Such a need may be addressed by a tandem-type color image forming apparatus equipped with image forming units for the individual colors of yellow, cyan, magenta, and black. In the tandem-type color image forming apparatus, toner images of the multi-colors are successively transferred onto an endless belt member, such as an intermediate transfer belt or a recording material transport belt on which a recording material is placed, one toner image over another. In such a tandem-type image forming apparatus, even if the drive source, such as a motor, is rotating at a constant speed, the endless transport speed of the endless belt member may vary if there is a variation in the thickness of the endless belt member, or if there is eccentricity in a belt drive roller or a drive gear engaged with the drive roller. As a result, a positional error may be caused between the overlapped toner images of the multi-colors, thus producing a color shift, small changes in color in a resultant printed image, or other forms of degradation in image quality.

In order to overcome such problems, one method may involve attaching a detector, such as an encoder, to the shaft of a driven roller that supports the endless belt member. In another method, a scale may be attached to the surface of the endless belt member and read by a detector. Based on the result of detection by such detectors, the endless transport speed of the endless belt member is detected and supplied for feedback control of the drive speed of the drive source for the endless belt member (see Japanese Laid-Open Patent Application Nos. 2004-220006 and 2005-115339). Because such a drive control method is capable of detecting speed variation components of the endless belt due to its thickness variation or the eccentricity in the belt drive roller or the drive gear, the speed variation component may be cancelled by performing an appropriate feedback control. Thus, the above conventional methods may enable the endless transport speed of the endless belt member to be maintained at a constant speed with accuracy, thus effectively overcoming the aforementioned problems.

In another image forming apparatus, cost reduction is achieved by reducing the number of components by driving the latent image carrier, such as a photosensitive drum, and the endless belt member using one drive unit (see Japanese Laid-Open Patent Application No. 2006-316985, for example).

However, when a drive control operation ("belt feedback control") for maintaining a constant endless transport speed of the endless belt member is performed in the system where the endless belt member and the latent image carrier are driven by a single drive unit, the following problem may arise.

During the belt feedback control, a constant endless transport speed of the endless belt member is maintained by cancelling a speed variation component of the endless belt member (due to the belt thickness variation or the eccentricity in the belt drive roller) by producing a speed variation of the opposite phase to the phase of the speed variation component in the drive speed of the drive source. Thus, the latent image carrier having no speed variation component is driven at the drive speed having the speed variation of the opposite phase. As a result, variation in the surface transport speed of the latent image carrier may be caused. If the speed variation component of the endless belt member has a large instantaneous speed variation component, the drive speed of the drive source may be instantaneously increased in order to cancel the instantaneous speed variation of the endless belt. As a result, a local image stretching or contraction may be produced in the obtained image, causing lines of reduced or increased color density or other forms of image degradation.

Generally, even if there is a surface transport speed variation in the latent image carrier, no image degradation due to the surface transport speed variation is caused if the period of such variation or an integer multiple of the period corresponds to the time ("latent-image-formation-to-transfer time interval") it takes for a latent image portion formed on the latent image carrier surface is moved to a transfer position of the endless belt member as the surface of the latent image carrier moves. This is due to the following.

When the surface transport speed is low, a latent image formed on the latent image carrier is stretched in a direction of movement of the latent image carrier surface (sub-scan direction). Conversely, when the surface transport speed of the latent image carrier is high, a latent image formed on the latent image carrier is contracted in the sub-scan direction. In contrast, when the surface transport speed is low, a toner image transferred onto the endless belt member or a recording material is contracted in the sub-scan direction. When the surface transport speed of the latent image carrier is high, a toner image transferred onto the endless belt member or the recording material is stretched in the sub-scan direction. When the period of the surface transport speed variation of the latent image carrier corresponds to the latent-image-formation-to-transfer time interval, a toner image corresponding to a latent image that is formed on the latent image carrier when the surface transport speed of the latent image carrier is low is transferred onto the endless belt member or the recording material when their surface transport speed is similarly low. Conversely, a toner image corresponding to a latent image that is formed on the latent image carrier when the surface transport speed is high is transferred onto the endless belt member or the recording material when the surface transport speed is similarly high.

As a result, the toner image corresponding to the latent image formed in an stretched condition is formed on the endless belt member or the recording material in a contracted condition with the corresponding scale ratio. Similarly, a toner image corresponding to a latent image formed in a contracted condition is formed on the endless belt member or the recording material in an stretched condition with the corresponding scale ratio. Thus, no stretching or contraction is caused in the resultant image due to the surface transfer speed variation of the latent image carrier, so that the aforementioned lines of image degradation do not occur.

However, the speed variation component of the endless belt member that would cause the aforementioned instantaneous speed variation may have a relatively long period, such as the period of the endless belt member or an integer multiple of the period of the endless movement of the endless belt, due to the engaging or disengaging of a component with the endless belt member. Practically, it is very difficult to design the apparatus such that the latent-image-formation-to-transfer time interval corresponds to such a relatively long period for various technical constraints. As a result, lines of image degradation may be caused in a printed image obtained by transferring the toner image from the latent image carrier at the time of the instantaneous speed variation of the endless belt member. In particular, if the belt feedback control for cancelling an instantaneous speed variation of the endless belt member is performed when the latent image formation on the latent image carrier and the toner image transfer from the latent image carrier are performed simultaneously, lines of image degradation may be caused at two locations per such speed variation, thus resulting in more serious image degradation.

The speed variation component that causes an instantaneous speed variation in the endless belt member may be caused regardless of the endless movement period of the endless belt member, such as by impact of the recording material with the endless belt member. For such an irregular speed variation component, the apparatus cannot be designed such that the latent-image-formation-to-transfer time interval corresponds to the period of such an irregular speed variation component, resulting in the lines of image degradation.

In one technology being developed by the present inventors, the endless belt member and the latent image carrier for a single-color image formation operation ("single-color latent image carrier") are driven by a single drive unit while the other latent image carriers (multi-color latent image carriers) are driven by a separate drive unit. In accordance with this technology, belt feedback control is performed in a multicolor image formation operation (second operating mode) in which two or more colors of toner images are overlapped but not in the single-color image formation operation (first operating mode) in which there is no superposing of toner images. Instead, in the first operating mode, the drive source is operated at a constant speed.

In accordance with this technology, the endless transport speed of the endless belt member is maintained at a constant speed with high accuracy during the multicolor image formation operation, so that the toner images of the multi-colors can be accurately overlaid upon one another without color displacement, thus preventing color displacement or small color changes in the printed image. In this case, because a speed variation is caused in the single-color latent image carrier due to the belt feedback control, color displacement may be caused to some extent between the single-color latent image carrier and the multi-color latent image carriers in which there is no color displacement and the like. However, of the speed variation component of the endless belt member, those due to the eccentricity in the belt drive roller or a drive gear engaged with the belt drive roller or the belt thickness variation have a relatively short period, so that the apparatus can be designed such that the period corresponds to the latent-image-formation-to-transfer time interval, thereby eliminating the color displacement due to the speed variation components.

On the other hand, with regard to the speed variation component of the endless belt member having a relatively long period (such as a belt thickness variation whose period corresponds to the entire track of the endless belt member), the amount of color displacement is smaller than in the case of the short period, so that the impact of color displacement and the like is minor. This is due to the fact that, in the case of a speed variation component having a very long period of six times or more than the latent-image-formation-to-transfer time interval, for example, the amount of change in the surface transport speed of the latent image carrier as a result of the belt feedback control for cancelling the speed variation component is very small in the period in which a latent image portion formed on the latent image carrier surface is moved to the transfer position of the endless belt member. Thus, the above technology is capable of preventing image degradation such as color displacement during a multicolor image formation operation.

Further, in accordance with this technology, in the single-color image formation operation, the surface transport speed of the single-color latent image carrier does not vary depending on the speed variation component of the endless belt member but remains constant, so that the image-degrading lines can be prevented during the single-color image formation operation. At this time, because the speed variation component of the endless belt member is not cancelled, image stretching or contraction corresponding to the endless transport speed variation of the endless belt member may be caused in the printed single-color image, resulting in some density irregularities. However, such density irregularities in the single-color image may also be caused when belt feedback control is performed in both a multicolor image formation operation and a single-color image formation operation. In addition, such density irregularities are minor compared to the image-degrading lines. Therefore, the technology can achieve improved image quality as regards to the single-color image compared to the case where belt feedback control is performed in both the multicolor image formation operation and the single-color image formation operation, because of the elimination of the lined image degradation.

However, research conducted by the present inventors has indicated that the aforementioned technology has the following problems. The temperature in the image forming apparatus greatly varies depending on the status of use of the apparatus. For example, the temperature increases in a continuous image formation operation, or it decreases when no image formation operation is performed for a long time. Such temperature changes cause a change in the diameter of the belt drive roller or the thickness of the belt due to thermal expansion. For example, when the diameter r of the belt drive roller is increased by thermal expansion, the endless transport speed V of the endless belt member may increase even if the input of rotary angular speed $\omega$ into the belt drive roller is constant because of the relationship $V=r\omega$. Conversely, as the diameter r of the belt drive roller decreases, the endless transport speed V of the endless belt member decreases even if the input of rotary angular speed $\omega$ into the belt drive roller is constant. The same principle applies when the belt thickness changes due to thermal expansion, or when a diameter or thickness change occurs in the roller or the belt due to a change in humidity in the case of certain types of roller or belt material.

In the aforementioned technology, no belt feedback control is performed during the single-color image formation operation, so that the change in the endless transport speed (average speed) of the endless belt member due to thermal expansion is not corrected during the single-color image formation operation. Thus, in the single-color image formation operation, the average speed of the endless belt member may vary depending on the temperature change in the image forming apparatus. As a result, the single-color image printed on a recording material may be shifted in the sub-scan direction, or the single-color image as a whole may be stretched or contracted.

This problem similarly occurs in an image forming apparatus in which the endless belt member and the latent image carriers are driven by a single drive unit, where drive source feedback control and belt feedback control are selectively performed. In the drive source feedback control, the drive speed of the drive unit is controlled to a constant speed based on a first detection signal obtained by detecting the rotating speed of the rotating drive force supplied by the drive unit to the endless belt member. In the belt feedback control, the drive speed of the drive unit is controlled to a constant speed based on a second detection signal obtained by detecting the endless transport speed of the endless belt member.

Thus, in such an image forming apparatus, no belt feedback control is performed when drive source feedback control is performed, so that the change in the endless transport speed (average speed) of the endless belt member due to the aforementioned temperature change is not corrected. As a result, an image printed on the recording material may be shifted in the sub-scan direction, or the entire image may be stretched or contracted.

SUMMARY OF THE INVENTION

The disadvantages of the prior art may be overcome by the present invention which, in one aspect, is an image forming apparatus including plural latent image carriers configured to carry latent images; plural developing units configured to develop the latent images on the latent image carriers; an endless belt member; a drive unit configured to supply a rotating drive force to the endless belt member so as to move the endless belt member in an endless manner; a first detecting unit configured to detect a rotating speed of the drive unit; a second detecting unit configured to detect an endless transport speed of the endless belt member; and a control unit configured to perform a drive control operation for controlling the rotating speed of the drive unit based on a first detection signal from the first detecting unit or a second detection signal from the second detecting unit selectively depending on a selection condition. The drive unit supplies the rotating drive force to at least one of the plural latent image carriers in addition to the endless belt member. The control unit is configured to, upon selection of the first detection signal in accordance with the selection condition, correct the rotating speed of the drive unit using the second detection signal such that an average value of the endless transport speed of the endless belt member approaches a target average value.

In another aspect, the invention is an image forming apparatus including a latent image carrier configured to carry a latent image; a developing unit configured to develop the latent image on the latent image carrier; an endless belt member; a drive unit configured to supply a rotating drive force to the endless belt member so as to move the endless belt member in an endless manner; a first detecting unit configured to detect a rotating speed of the drive unit; a second detecting unit configured to detect an endless transport speed of the endless belt member; and a control unit configured to perform a drive control for controlling the rotating speed of the drive unit based on a first detection signal from the first detecting unit or a second detection signal from the second detecting unit selectively depending on a selection condition. The drive unit is configured to supply the rotating drive force to the latent image carrier in addition to the endless belt member. The control unit is configured to perform a correcting process, upon selection of the first detection signal in accordance with the selection condition, in order to correct the rotating speed of the drive unit using the second detection signal so that an average value of the endless transport speed of the endless belt member approaches a target average value.

DETAILED DESCRIPTION OF THE PREFERRED EMBODIMENTS

Figure 1:
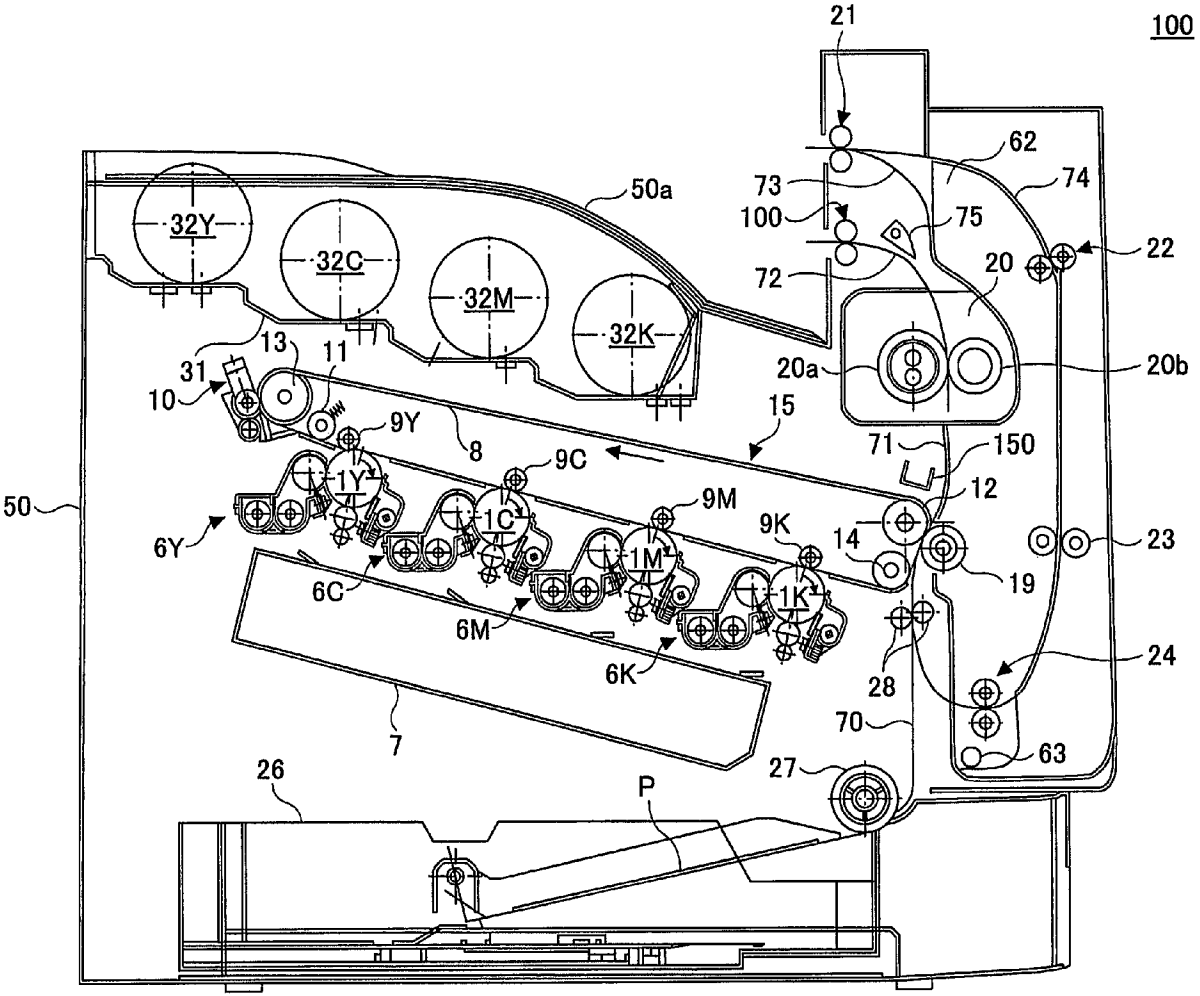
FIG. 1 illustrates a printer (image forming apparatus) 100 according to an embodiment of the present invention.
Figure 2:
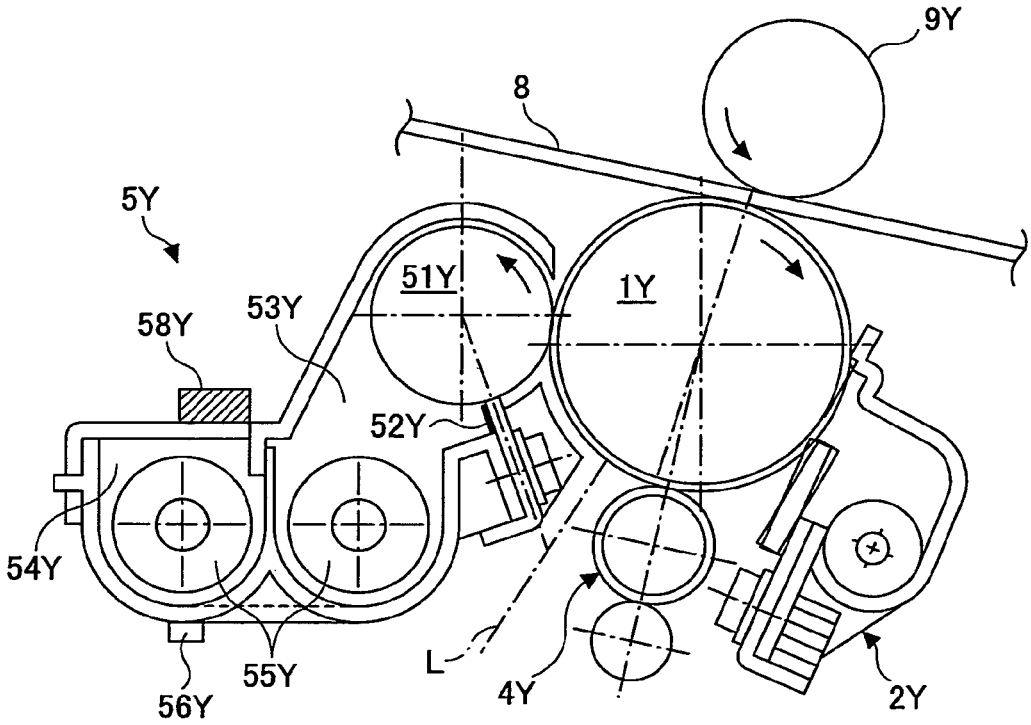
FIG. 2 is an enlarged view of a process unit for the color of yellow (Y) of the printer 100.

FIG. 1 illustrates a printer 100 according to an embodiment of the present invention. The printer 100 includes four process units 6Y, 6C, 6M, and 6K configured to form toner images of yellow (Y), cyan (C), magenta (M), and black (K). The process units 6Y, 6C, 6M, and 6K have the same structure. FIG. 2 illustrates the process unit 6Y for producing a Y toner image. The process unit 6Y includes a photosensitive drum 1Y (latent image carrier); a drum cleaning unit 2Y; a neutralizing unit (not shown); a charging unit 4Y; and a developing unit 5Y. The process unit 6Y is detachable from a printer main body 50, so that the expendable components in the process unit 6Y, for example, can be replaced all at once.

Referring to FIG. 2, the charging unit 4Y is configured to charge a surface of the photosensitive drum 1Y uniformly as the photosensitive drum 1Y is rotated in the direction indicated by an arrow in it by a drive unit (not shown). The uniformly charged surface of the photosensitive drum 1Y is then scanned with an exposing laser beam of light L, whereby an electrostatic latent image for the color Y is formed on the photosensitive drum 1Y. The electrostatic latent image (Y) is then developed into a Y toner image by the developing unit 5Y using a Y developing agent containing a Y toner and a magnetic carrier. The Y toner image is initially transferred onto the intermediate transfer belt 8 (endless belt member) in an intermediate transfer step. Residual toner on the surface of the photosensitive drum 1Y is removed by the drum cleaning unit 2Y after the intermediate transfer step, and residual charge on the photosensitive drum 1Y after the cleaning step is neutralized by the neutralizing unit (not shown). The neutralizing step initializes the surface of the photosensitive drum 1Y for the next sequence of image formation. Similar steps are performed for the process units 6C, 6M, and 6K, whereby C, M, and K toner images are formed on the photosensitive drums 1C, 1M, and 1K, respectively, and then transferred onto the intermediate transfer belt 8.

The developing unit 5Y includes a developing roll 51Y that is partially exposed via an opening of a casing of the developing unit 5Y. The developing unit 5Y further includes a pair of transport screws 55Y disposed in parallel, a doctor blade 52Y, and a toner density sensor 56Y. Within the casing of the developing unit 5Y, there is also contained the Y developing agent (not shown) including the magnetic carrier and the Y toner. The Y developing agent is charged by friction while it is stirred and transported by the pair of transport screws 55Y, before a layer of the developing agent is supported on the surface of the developing roll 51Y. After the thickness of the layer of the developing agent is regulated by the doctor blade 52Y, the developing agent is transported to a developing area opposite the photosensitive drum 1Y. In the developing area, the Y toner is caused to attach to the electrostatic latent image on the photosensitive drum 1Y, thus forming a Y toner image on the photosensitive drum 1Y. The Y developing agent from which the Y toner has been consumed by the developing step is returned into the casing of the developing unit 5Y as the developing roll 51Y rotates.

Still referring to FIG. 2, the two transport screws 55Y are separated by a dividing wall, defining a first supply unit 53Y in which the developing roll 51Y and the transport screw 55Y are contained, and a second supply unit 54Y in which the transport screw 55Y to the right of the drawing is contained. The right-hand side transport screw 55Y is rotated by a drive unit (not shown) in order to transport the Y developing agent in a direction from the upper surface to the lower surface of the sheet of the drawing within the first supply unit 53Y, while supplying the Y developing agent to the developing roll 51Y. The Y developing agent that has been supplied near the end of the first supply unit 53Y by the right-hand side transport screw 55Y passes an opening (not shown) provided in the dividing wall and advances into the second supply unit 54Y. In the second supply unit 54Y, the left-hand side transport screw 55Y is rotated by a drive unit (not shown) in order to transport the Y developing agent supplied from the first supply unit 53Y in a direction opposite to the direction of supply by the right transport screw 55Y. Specifically, the Y developing agent that has been transported near the end of the second supply unit 54Y by the left transport screw 55Y passes another opening (not shown) in the dividing wall and advances back into the first supply unit 53Y.

The toner density sensor 56Y includes a permeability sensor and is disposed on a bottom wall of the second supply unit 54Y and configured to output a voltage corresponding to the permeability of the Y developing agent that passes above the sensor. The permeability of a two-component developing agent containing a toner and a magnetic carrier exhibits a good correlation with toner concentration. Therefore, the toner density sensor 56Y outputs a voltage whose value corresponds to the Y toner concentration. The value of the output voltage is sent to a control unit (not shown) which may include a RAM (random access memory) in which a Y target value "Vtref" of the output voltage from the toner density sensor 56Y is stored. The RAM may also store data of the target values Vtref of output voltages for the other colors C, M, and K from the toner density sensors (not shown) disposed in the other developing units. Vtref for Y is used for drive control of a toner transport unit for Y, as will be described later. Specifically, the control unit controls the driving of the toner transport unit for Y in order to supply the Y toner to the second supply unit 54Y such that the value of the output voltage from the toner density sensor 56Y approaches the Vtref for Y. This supply operation maintains a predetermined range of the Y toner concentration of the Y developing agent in the developing unit 5Y. A similar toner supply control operation is performed for the developing units in the other process units for the colors of C, M, and K.

Referring back to FIG. 1, an optical writing unit 7 (latent image formation unit) is disposed under the process units 6Y, 6C, 6M, and 6K. The optical writing unit 7 is configured to irradiate the photosensitive drums in the process units 6Y, 6C, 6M, and 6K with the laser beam of light L in accordance with image information, thus exposing the photosensitive drums. The exposing step forms electrostatic latent images for Y, C, M, and K on the photosensitive drums 1Y, 1C, 1M, and 1K, respectively. The optical writing unit 7 may be configured to scan the photosensitive drums with the laser beam of light L via a polygon mirror (not shown) rotated by a motor and plural optical lenses or mirrors.

Under the optical writing unit 7 in FIG. 1, a sheet storage cassette 26 and a sheet feed roller 27 (sheet storage units) is disposed. The sheet storage cassette 26 stores a stack of transfer sheets P (recording material), with the upper-most transfer sheet P being contacted by the sheet-feed roller 27. When the sheet-feed roller 27 is rotated in anticlockwise direction by a drive unit (not shown), the upper-most transfer sheet P is fed out onto a sheet-feeding path 70.

Near the end of the sheet-feeding path 70, a registration roller pair 28 is disposed. The registration roller pair 28 is configured to rotate in order to hold the transfer sheet P between them and to stop rotating once the transfer sheet P is held. The registration roller pair 28 is then rotated to send the transfer sheet P to a secondary transfer nip at an appropriate timing as will be described later.

Above the process units 6Y, 6C, 6M, and 6K, a transfer unit 15 is disposed. The transfer unit 15 includes an intermediate transfer belt 8, a secondary transfer bias roller 19, and a belt cleaning unit 10. The transfer unit 15 also includes four primary transfer bias rollers 9Y, 9C, 9M, and 9K; a drive roller 12; a cleaning backup roller 13; a driven roller 14; and a tension roller 11 (see FIG. 6). The intermediate transfer belt 8 is extended across these rollers and rotated by the drive roller 12 endlessly in anticlockwise direction. The primary transfer bias rollers 9Y, 9C, 9M, and 9K and the photosensitive drums 1Y, 1C, 1M, and 1K retain the intermediate transfer belt 8 between them, thus forming primary transfer nips. In this system, a transfer bias of a polarity (such as positive) opposite to the polarity of the toner is applied to the back surface of the intermediate transfer belt 8 (i.e., inside the loop of the belt). All of the rollers except for the primary transfer bias rollers 9Y, 9C, 9M, and 9K are electrically grounded. Thus, as the intermediate transfer belt 8 is endlessly moved and travels through the Y, C, M, and K primary transfer nips, the Y, C, M, and K toner images on the photosensitive drums 1Y, 1C, 1M, and 1K are successively transferred onto the intermediate transfer belt 8 one color upon another in a primary transfer operation. As a result, a four-color overlapped toner image is formed.

Figure 6:
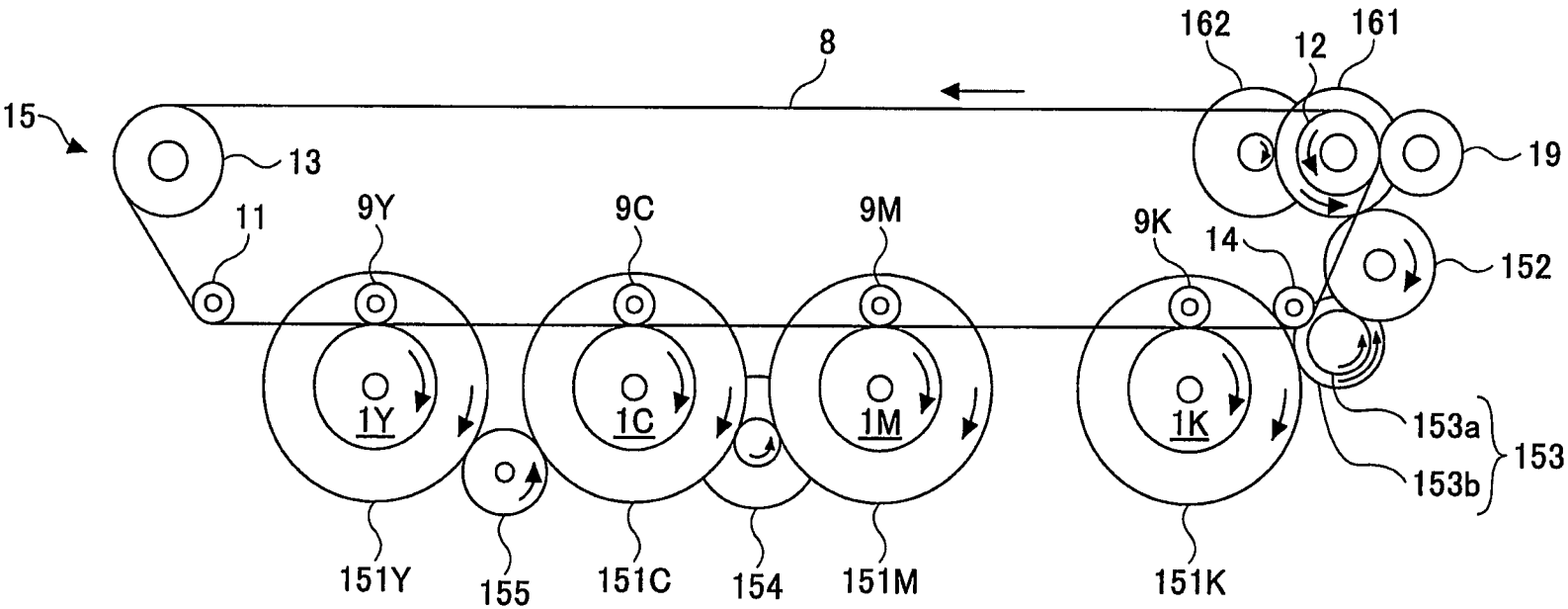
FIG. 6 is a side view of the transfer unit, photosensitive drums for multi-colors, and gears supported within a printer main body according to an embodiment of the present invention.

Referring to FIG. 6, the drive roller 12 and the secondary transfer bias roller 19 hold the intermediate transfer belt 8 between them, forming a secondary transfer nip. The four-color toner image (visible image) formed on the intermediate transfer belt 8 is transferred onto the transfer sheet P via the secondary transfer nip, forming a full-color toner image, with the transfer sheet P providing the color of white. After the secondary transfer nip, some toner remains on the intermediate transfer belt 8 that was not transferred onto the transfer sheet P. Such residual toner is cleaned by the belt cleaning unit 10 (FIG. 1). The transfer sheet P with the four-color toner image transferred thereon is sent to the fusing unit 20 along the transport path 71.

Referring to FIG. 1, the fusing unit 20 includes a fusing roller 20*a* having a heat source, such as a halogen lamp, and a pressure roller 20*b* that rotates while being contacted with the fusing roller 20*a* under a predetermined pressure. Thus, the fusing roller 20*a* and the pressure roller 20*b* form a fusing nip. In the fusing nip, the surface of the transfer sheet P on which the toner image is carried is closely attached to the fusing roller 20*a*. As a result, the toner in the toner image is softened by the heat and pressure provided by the fusing unit 20, whereby the full-color image is fused onto the transfer sheet P.

The transfer sheet P with the full-color image fused by the fusing unit 20 is thereafter transported to a branching point between a sheet-ejecting path 72 and a pre-inversion transport path 73. At this branching point, a first switching nail 75 is disposed in a rotatable manner. The path of the transfer sheet P can be selected by the rotating movement of the first switching nail 75. Specifically, the sheet-ejecting path 72 can be selected by moving the tip of the first switching nail 75 closer to the pre-inversion transport path 73. The pre-inversion transport path 73 can be selected by moving the tip of the first switching nail 75 away from the pre-inversion transport path 73.

When the sheet-ejecting path 72 is selected by the first switching nail 75, the transfer sheet P is transported along the sheet-ejecting path 72 and then ejected onto the stacking unit 50*a* via the sheet-ejecting roller pair 100. On the other hand, when the pre-inversion transport path 73 is selected by the first switching nail 75, the transfer sheet P enters a nip area formed in the inverting roller pair 21 along the pre-inversion transport path 73. The transfer sheet P held between the rollers of the inverting roller pair 21 is transported toward the stacking unit 50*a*. Just before the trailing edge of the transfer sheet P enters the nip of the inverting roller pair 21, the rotating direction of the inverting roller pair 21 is inverted. As a result, the transfer sheet P is transported in the opposite direction, so that the trailing edge of the transfer sheet P enters the inverting transport path 74.

The inverting transport path 74 extends downwardly as illustrated in FIG. 1. Along the inverting transport path 74, there are disposed a first inverting transport roller pair 22, a second inverting transport roller pair 23, and a third inverting transport roller pair 24. Thus, the transfer sheet P is transported via the nipping portions of the roller pairs 22, 23, and 24, and sent back onto the sheet-feeding path 70. At this time, however, the transfer sheet P enters the secondary transfer nip with its non-image-carrying surface being closely attached onto the intermediate transfer belt 8. Thus, a second four-color toner image on the intermediate transfer belt is transferred onto the non-image-carrying surface of the transfer sheet P in the secondary transfer operation. Thereafter, the transfer sheet P travels through the transport path 71, the fusing unit 20, and the sheet-ejecting path a 72, and eventually ejected onto the stacking unit 50*a* via the sheet-ejecting roller pair 100. In this way, full-color images are formed on both sides of the transfer sheet P.

A bottle support unit 31 is disposed between the transfer unit 15 and the stacking unit 50*a*. The bottle support unit 31 contains toner bottles (toner container units) 32Y, 32C, 32M, and 32K containing the Y, C, M, and K toner, respectively. The toner bottles 32Y, 32C, 32M, and 32K are disposed with a slight angle with respect to the horizontal, with the toner bottle 32Y disposed at the highest position while the other toner bottles 32C, 32M, and 32K are positioned gradually lower. The Y, C, M, and K toners in the toner bottles 32Y, 32C, 32M, and 32K are supplied to the corresponding developing units in the process units 6Y, 6C, 6M, and 6K by a toner transport unit which will be described later. The toner bottles 32Y, 32C, 32M, and 32K are detachable from the printer main body independently of the process units 6Y, 6C, 6M, and 6K.

In accordance with the present embodiment, the state of contact between the photosensitive drums and the intermediate transfer belt 8 is varied between the monochrome mode (first operating mode) and the multicolor image formation operation mode (second operating mode). In the monochrome, mode, a single-color image of only the color K is formed. In the multicolor image formation operation mode, a color image is formed using all of the four colors of Y, C, M, and K.

Specifically, of the four primary transfer bias rollers 9Y, 9C, 9M, and 9K of the transfer unit 15, the primary transfer bias roller 9K is supported by a dedicated bracket (not shown) separately from the other primary transfer bias rollers. The primary transfer bias rollers 9Y, 9C, and 9M are supported by a common movable bracket (not shown). The common movable bracket is movable toward or away from the photosensitive drum 1Y, 1C, and 1M using a solenoid (not shown). When the common movable bracket is moved away from the photosensitive drums 1Y, 1C, and 1M, the intermediate transfer belt 8 is distanced away from the photosensitive drums 1Y, 1C, and 1M while remaining in contact with the photosensitive drum 1K. Thus, in the monochrome mode, an image formation operation is performed with only the photosensitive drum 1K contacted with the intermediate transfer belt 8. At this time, only the photosensitive drum 1K is rotated while the remaining photosensitive drums 1Y, 1C, and 1M are not rotated.

When the common movable bracket is moved toward the photosensitive drums 1Y, 1C, and 1M, the intermediate transfer belt 8 comes into contact with the photosensitive drums 1Y; 1C, and 1M while the intermediate transfer belt 8 remains in contact with the photosensitive drum 1K. Thus, in the color mode, an image formation operation is performed with all of the four photosensitive drums 1Y, 1C, 1M, and 1K contacting the intermediate transfer belt 8. In accordance with the present embodiment, the common movable bracket and the solenoid provide a contacting/separating unit configured to bring the photosensitive drum and the intermediate transfer belt 8 into or out of contact with each other.

The printer 100 may include a main control unit (not shown) for controlling the process units 6Y, 6C, 6M, and 6K and the optical writing unit 7. The main control unit may include a CPU (central processing unit), a RAM (random access memory), and a ROM (read only memory). The main control unit may be configured to control the driving of the various process units or the optical writing unit 7 based on a program stored in the ROM. Further, separately from the main control unit, the printer 100 may include a drive control unit (not shown). The drive control unit may include a CPU, a ROM, and a non-volatile RAM, and may be configured to control a common drive motor or a photosensitive drum motor, which will be described below, based on a program stored in the ROM.

Figure 3:
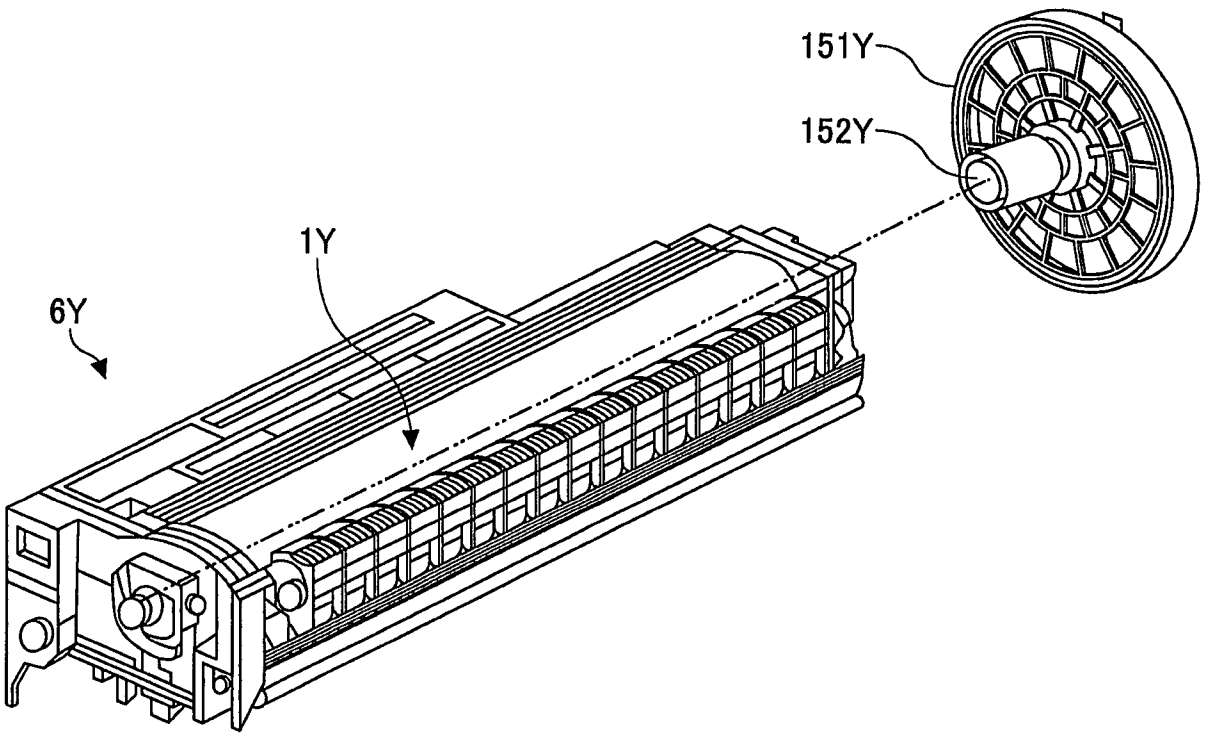
FIG. 3 is a perspective view of the process unit of FIG. 2 and an associated photosensitive drum gear.

FIG. 3 is a perspective view of a process unit 6Y and a photosensitive drum gear 151Y. The photosensitive drum gear 151Y is rotatably supported in the printer main body. The process unit 6Y is detachable from the printer main body. The process unit 6Y includes the photosensitive drum 1Y and an axle member protruding from each end of the photosensitive drum 1Y along its rotating axis. Of the two axle members, the one on the far-side end of the photosensitive drum in FIG. 3 (which is not visible in the drawing) has a coupling member as well known in the art. The coupling member of the photosensitive drum 1Y is coupled with a coupling unit 152Y formed on the photosensitive drum gear 151Y that is disposed on the printer main body. Thus, a rotating drive force provided by the photosensitive drum gear 151Y can be transmitted to the photosensitive drum 1Y via the coupling unit 152Y. When the process unit 6Y is detached from the printer main body, the coupling between the photosensitive drum 1Y and the photosensitive drum gear 151Y via the coupling unit 152Y is released. The other process units for the various other colors have similar structures.

Figure 4:
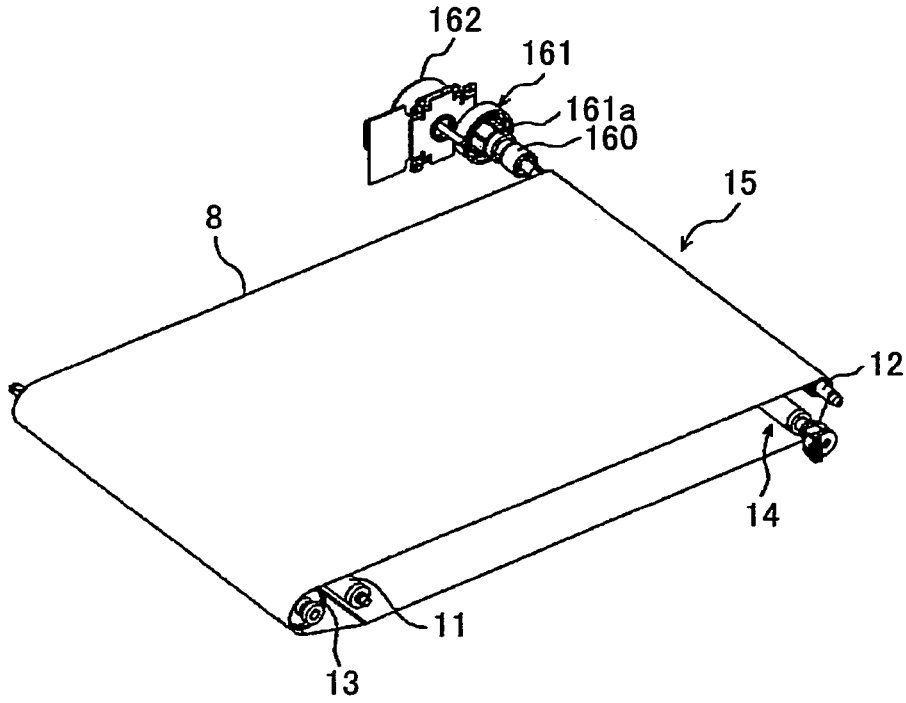
FIG. 4 is a perspective view of a transfer, unit including an intermediate transfer belt and a motor configured to drive the intermediate transfer belt.
Figure 5:
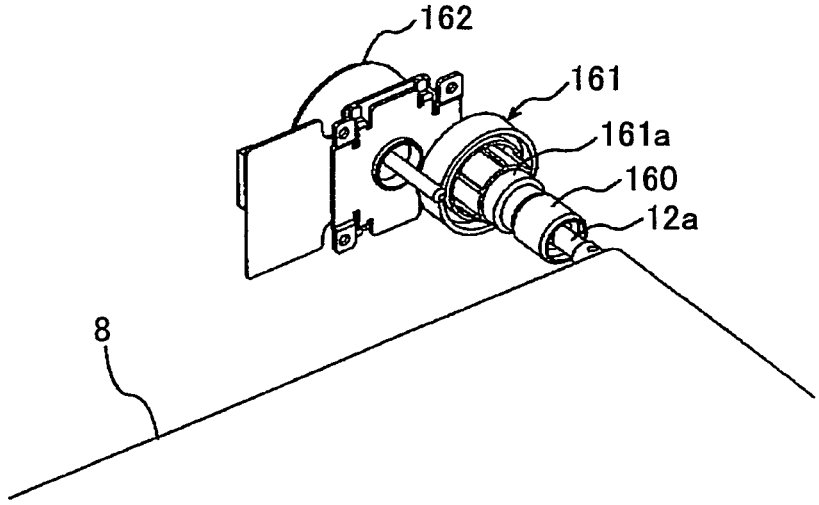
FIG. 5 is an enlarged perspective view of the transfer unit of FIG. 4.

FIG. 4 is a perspective view of the transfer unit 15 and a motor configured to drive the intermediate transfer belt 8. FIG. 5 is a perspective view of the motor and a structure surrounding the motor. With reference to FIGS. 4 and 5, a coupling 160 is fixed to one end of a shaft 12*a* of the drive roller 12. A belt drive relay gear 161 is rotatably supported on the printer main body, with a coupling unit 161*a* formed at the center of the belt drive relay gear 161. The transfer unit 15 is detachable from the printer main body. The transfer unit 15 is installed within the printer main body as illustrated in FIGS. 4 and 5, where the coupling 160 fixed to the drive roller 12 of the transfer unit 15 is axially coupled with the coupling unit 161*a* of the belt drive relay gear 161 supported within the printer main body. When the transfer unit 15 is detached from within the printer main body, the coupling between the coupling 160 and the coupling unit 161*a* is released.

In the printer main body, a common drive motor 162 is fixed near the belt drive relay gear 161, with a motor gear of the common drive motor 162 being meshed with the belt drive relay gear 161. Thus, when the common drive motor 162 rotates, the driving force is transmitted via the belt drive relay gear 161, the coupling connecting unit, and the drive roller 12 to the intermediate transfer belt 8.

FIG. 6 illustrates the transfer unit 15, the photosensitive drums 1Y, 1C, 1M, and 1K, and the various gears rotatably supported in the printer main body. The gears include photosensitive drum gears 151Y, 151C, 151M, and 151K, the belt drive relay gear 161, a first K relay gear 152, a second K relay gear 153, and a Y relay gear 155. A color photosensitive drum motor 154 is also fixed in the printer main body.

The belt drive relay gear 161 is engaged with the motor gear of the common drive motor 162 and also with the first K relay gear 152. The first K relay gear 152 is disposed near the second K relay gear 153. The second K relay gear 153 is integrally formed with an input gear 153*a* and an output gear 153*b* on the same axis. The first K relay gear 152 is also meshed with the input gear 153*a*. The output gear 153*b* of the second K relay gear 153 is meshed with the photosensitive drum gear 151K. Such a gear arrangement allows the rotating drive force of the common drive motor 162 to be transmitted to the photosensitive drum 1K via the belt drive relay gear 161, the first K relay gear 152, the second K relay gear 153, and the photosensitive drum gear 151K. Thus, in accordance with the present embodiment, the common drive motor 162 provides a drive source for the intermediate transfer belt 8 and the photosensitive drum 1K.

On the other hand, the photosensitive drums 1Y, 1C, and 1M are driven by a drive source separate from the common drive motor 162. Specifically, the motor gear of the color photosensitive drum motor 154, which is fixed within the printer main body, is positioned between, and meshed with, the photosensitive drum gears 151C and 151M. Thus, the rotating drive force of the color photosensitive drum motor 154 is directly transmitted via the motor gear to the photosensitive drum gears 151C and 151M.

The Y relay gear 155 rotatably supported on the printer main body is positioned between, and meshed with, the photosensitive drum gears 151Y and 151C. Thus, the rotating drive force of the photosensitive drum gear 151C is transmitted via the Y relay gear 155 to the photosensitive drum gear 151Y.

Figure 7:
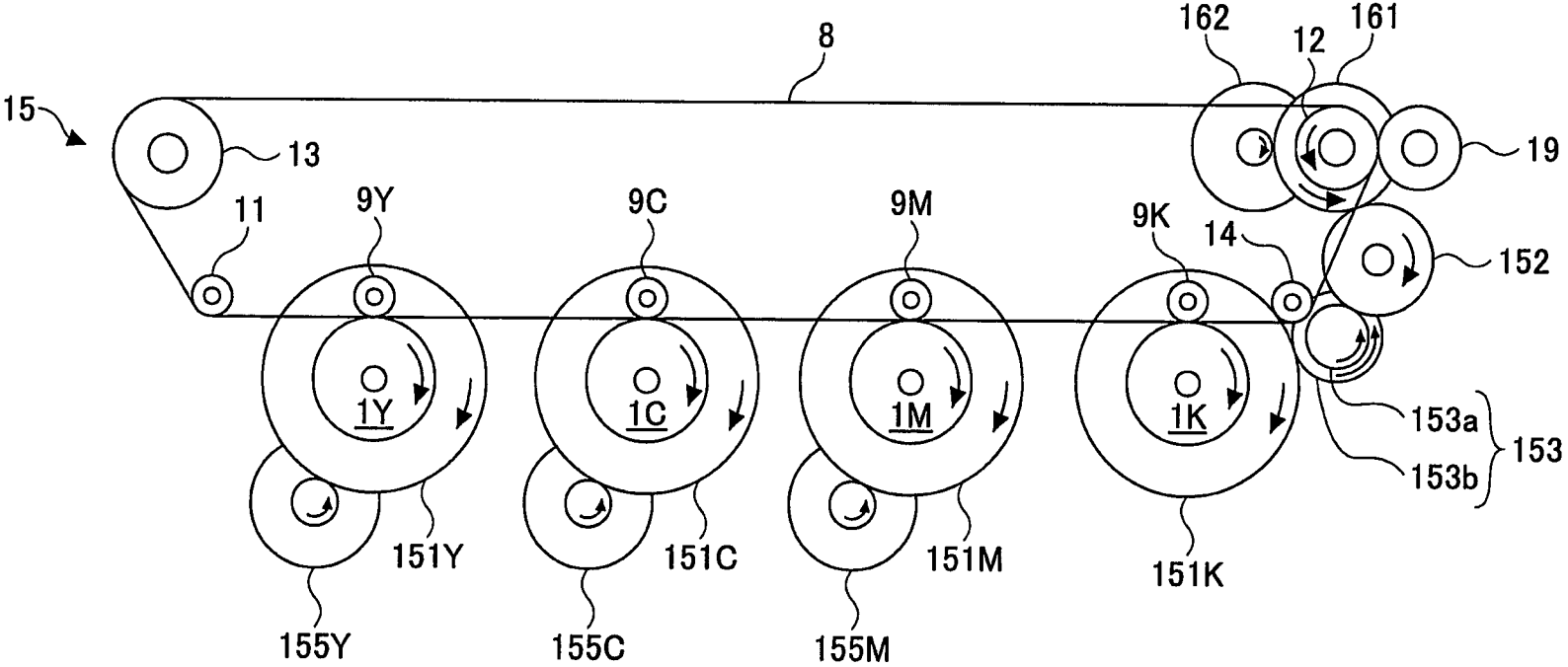
FIG. 7 is a side view of the transfer unit, the photosensitive drums for multi-colors, and the gears supported within the printer main body according to another embodiment of the present invention.

FIG. 7 illustrates another embodiment of the present invention in which the photosensitive drums 1Y, 1C, and 1M are driven by individual photosensitive drum motors 155Y, 155C, and 155M. In this embodiment, the motor gears of the photosensitive drum motors 155Y, 155C, and 155M are meshed with the corresponding photosensitive drum gears 151Y, 151C, and 151M.

Figure 8:
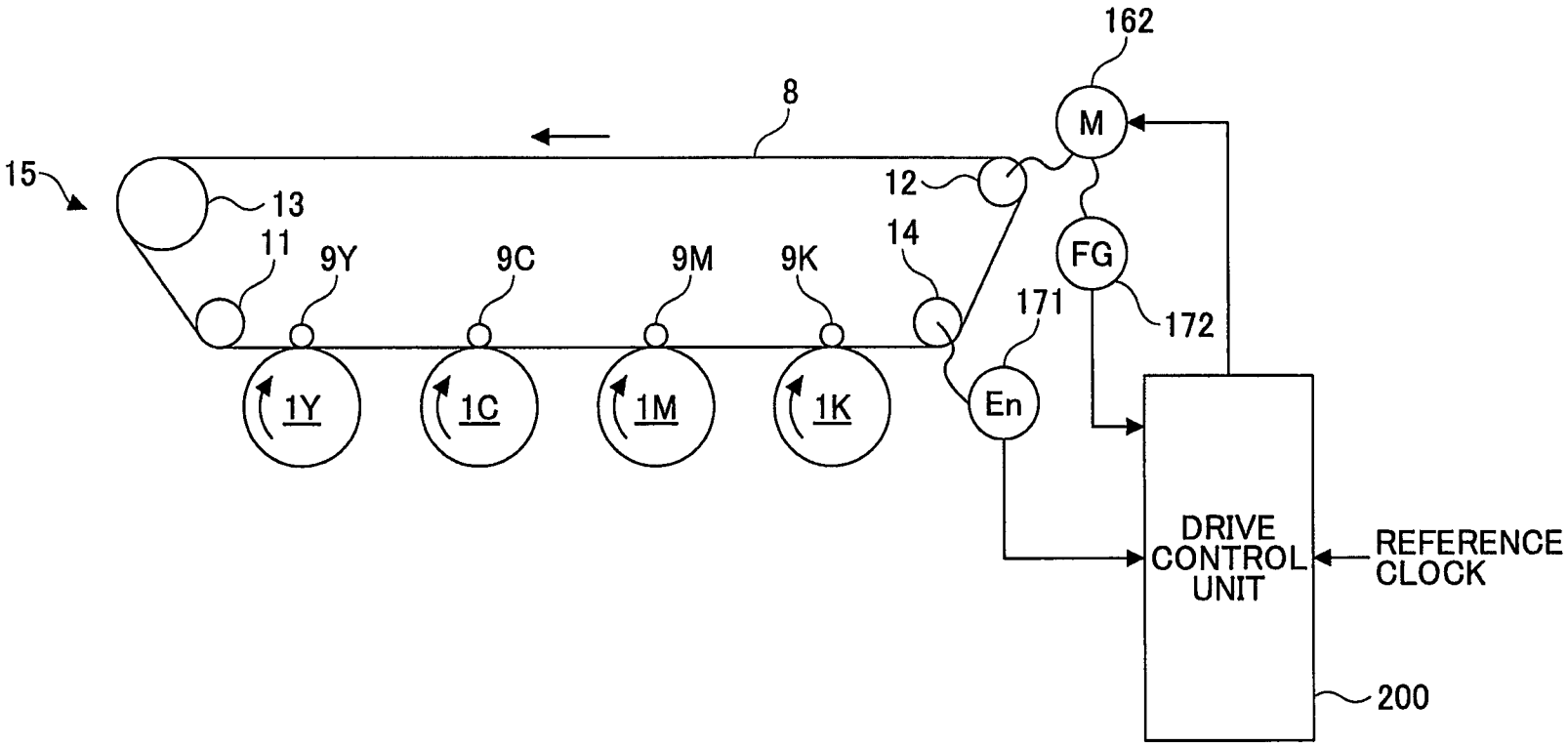
FIG. 8 illustrates an electrical connection of the motor, a frequency generator, and an encoder with a drive control unit.

FIG. 8 illustrates the transfer unit 15 and a drive control unit 200 for controlling the driving of the transfer unit 15. A linear speed (surface transport speed) of the driven roller 14, which is one of the belt-extending members disposed inside the loop of the intermediate transfer belt 8 and which is driven by the endless movement of the belt, is the same as a linear speed (endless transport speed) of the intermediate transfer belt 8. Thus, the rotary angular speed or the rotary angular displacement of the driven roller 14 indirectly indicate the endless transport speed of the intermediate transfer belt 8.

A roller encoder 171 (second detecting unit) which may include a rotary encoder is fixed to the axle member of the driven roller 14. The roller encoder 171 detects a rotary angular speed or a rotary angular displacement of the driven roller 14, and outputs a detected result to the drive control unit 200. The roller encoder 171 may also be configured to detect an endless transport speed variation of the intermediate transfer belt 8 due to a diameter change in the drive roller 12 caused by a temperature change. The roller encoder 171 may also be configured to detect an endless transport speed of the intermediate transfer belt 8. Based on an output signal (second detection signal) from the roller encoder 171, the drive control unit 200 can monitor a speed variation or an endless transport speed (average value) of the intermediate transfer belt 8.

Alternatively, the second detecting unit may include a detecting unit other than the roller encoder 171. For example, a scale having plural markings at a predetermined pitch may be attached to the intermediate transfer belt 8 along the belt rotated direction, so that the markings can be detected by an optical sensor providing a speed variation or speed signal based on the time interval of detection of the markings. Further alternatively, an optical image sensor that is often used in the optical mouse unit of personal computers may be used to detect the belt surface transport speed.

In a successive print operation in which an image is successively printed on plural transfer sheets, the diameter of the drive roller 12 may gradually increase due to the temperature increase in the printer. Conversely, the diameter of the drive roller 12 may gradually decrease as the temperature within the printer decreases following the end of the successive print operation. Because there is the relationship $V=r\omega$ where V is the linear speed of the intermediate transfer belt 8, r is the radius of the drive roller 12, and $\omega$ is an angular speed of the drive roller 12, the linear speed V of the belt varies as the diameter of the drive roller 12 varies under a constant angular speed $\omega$, i.e., a constant drive speed of the common drive motor 162. As a result, toner images of the multi-colors may be displaced from one another. Such a displacement may be referred to as a "registration error".

Thus, in the color mode, the drive control unit 200 controls the acceleration or deceleration of the common drive motor 162 via PLL control so that the frequently of pulse signals outputted from the roller encoder 171 corresponds to the frequency of a reference clock. In this way, the driven roller 14 to which the roller encoder 171 is attached is controlled to rotate at, a constant rotary angular speed, thus maintaining a constant speed of the intermediate transfer belt 8. Specifically, the drive speed of the common drive motor 162 is controlled such that the endless transport speed variation of the intermediate transfer belt 8 can be cancelled and a target average value of the endless transport speed can be achieved.

The aforementioned PLL control may involve cancelling a periodic speed variation due to the eccentricity of the drive roller 12, in addition to the speed variation due to the diameter change in the drive roller 12 over time. When the drive roller 12 has eccentricity, a small speed variation may be caused in the intermediate transfer belt 8. Such a small speed variation may be plotted as a sine curve whose period corresponds to the circumference of the drive roller 12. The aforementioned PLL control may involve detecting such a small speed variation so that the driving of the common drive motor 162 can be controlled based on the speed variation.

Figure 9:
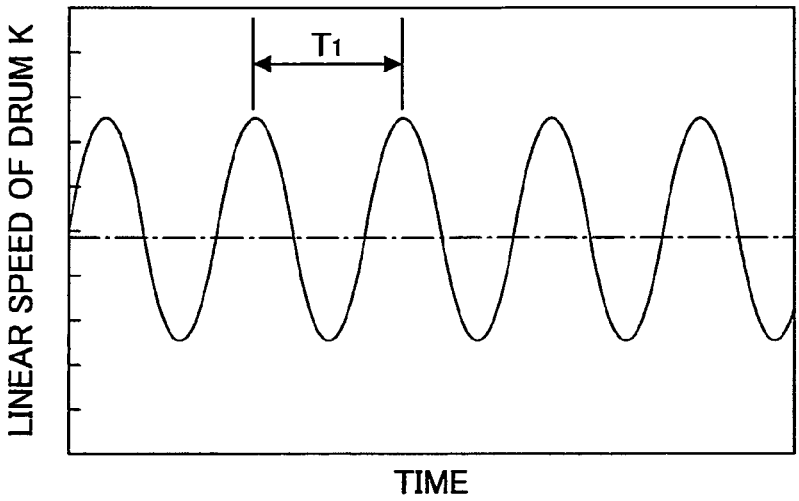
FIG. 9 is a graph plotting a speed variation curve of the K photosensitive drum having a period synchronized with a rotating period of a drive roller.
Figure 10:
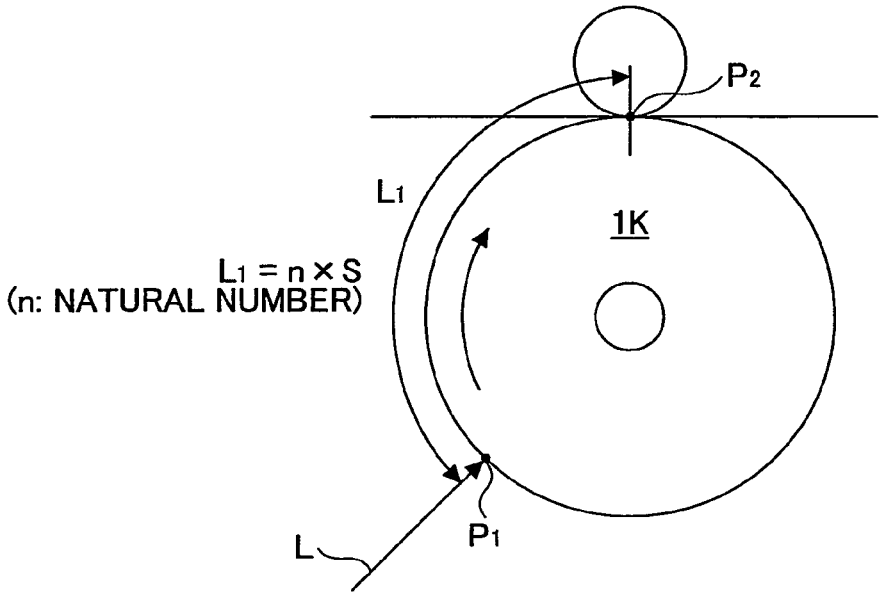
FIG. 10 illustrates a distance between an optical writing position on the surface of the K photosensitive drum and the center of a transfer nip.

However, the detection of a small speed variation caused by the eccentricity in the drive roller 12 and the feedback control of the common drive motor 162 based on the detected result may lead to a small variation in the linear speed of the photosensitive drum 1K, as illustrated in FIG. 9, in addition to stabilizing the speed of the intermediate transfer belt 8. The period of the sine-curve-shaped speed variation curve illustrated in FIG. 9 is the same as the period of rotation of the drive roller 12. When a speed variation having such a period appears in the photosensitive drum 1K, image degradation due to the speed variation can be prevented as follows. Namely, as illustrated in FIG. 10, a write-to-transfer distance L1 between an optical writing position P1 on the surface of the photosensitive drum 1K and a central position P2 of the primary transfer nip along the belt transport direction is set to be an integer multiple of the circumference S of the drive roller 12. In this way, the dot shapes of the toner image transferred onto the belt can be stabilized by maintaining the same linear speed of the photosensitive drum 1K at the time of optical writing and transfer.

Figure 11:
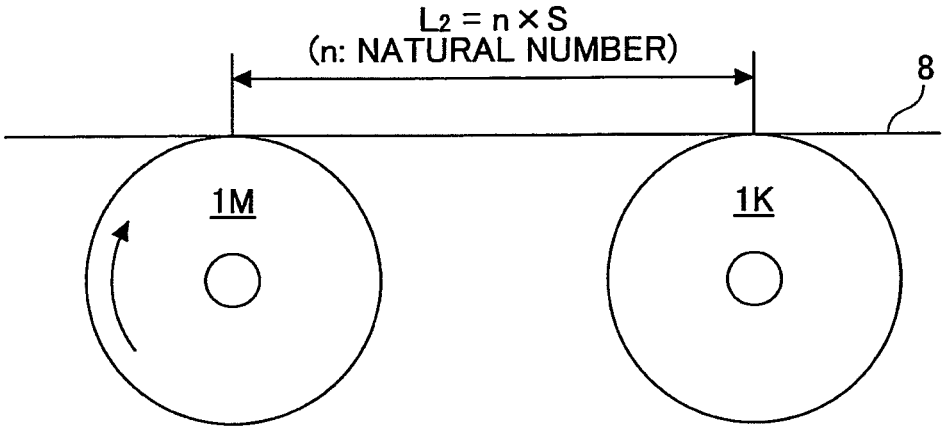
FIG. 11 illustrates a distance between photosensitive drums.

When the setting described with reference to FIG. 10 is difficult, a photosensitive drum distance L2 corresponding to the pitch of the photosensitive drums may be set to be an integer multiple of the circumference S of the drive roller 12, as illustrated in FIG. 11. In this way, a constant linear speed of the intermediate transfer belt 8 can be maintained when various positions of the toner image in the sub-scan direction pass the transfer nips, thus preventing the registration error of the multi-colors.

Figure 12:
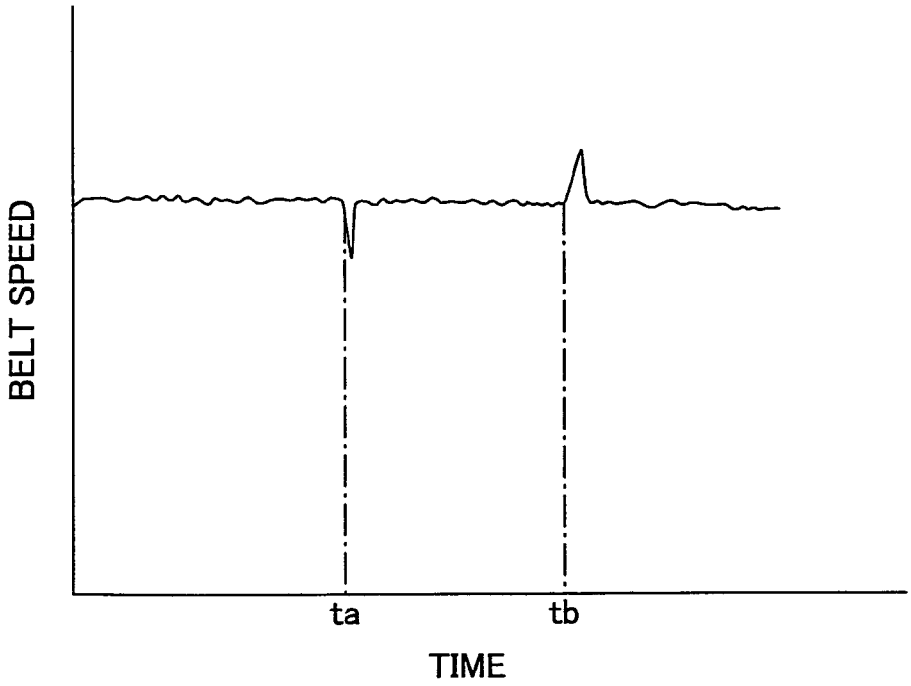
FIG. 12 is a graph indicating an instantaneous speed variation that appears in the intermediate transfer belt.

Further, in accordance with the present embodiment, an instantaneous speed variation as illustrated in FIG. 12 can also be reduced by quickly adjusting the drive speed of the common drive motor 162. FIG. 12 is a graph in which "ta" indicates the point in time when the leading edge of a transfer sheet enters the secondary transfer nip (which may be referred to as a "leading edge entry timing"). "tb" indicates a point in time when the trailing edge of the transfer sheet leaves the secondary transfer nip (which may be referred to as a "trailing edge exit timing".

As illustrated, at the leading edge entry timing (ta), the speed of the intermediate transfer belt 8 drops instantaneously and significantly. At the trailing edge exit timing (tb), the speed of the intermediate transfer belt 8 increases instantaneously and significantly. Such instantaneous speed variations can be quickly responded to by the aforementioned PLL control, so that the drive speed of the common drive motor 162 can be adjusted to reduce the duration of the instantaneous speed variation. However, when the drive speed of the common drive motor 162 is adjusted in order to reduce such instantaneous speed variations, an instantaneous speed variation may be caused in the speed of the photosensitive drum 1K. Because such instantaneous speed variations typically have long or irregular periods, it is extremely difficult to set the write-to-transfer distance L1 to be an integer multiple of the wavelength of the instantaneous speed variation, as described with reference to FIG. 10, or to set the photosensitive drum distance L2 to be an integer multiple of the wavelength of the instantaneous speed variation, as described with reference to FIG. 11. Thus, it is difficult to prevent the development of the lines of image degradation due to the instantaneous speed variation in the speed of the photosensitive drum 1K.

Thus, in accordance with the present embodiment, the aforementioned PLL control (belt feedback control) is performed during an image formation operation in the color mode (second operating mode) so that the endless transport speed variation of the intermediate transfer belt 8 can be cancelled, while the drive speed of the common drive motor 162 is controlled such that a target average value of the endless transport speed can be achieved, thus preventing color displacement or other noticeable image degradation. On the other hand, during an image formation operation in the monochrome mode (first operating mode) that involves no overlapping of toner images (i.e., there is no color displacement), the aforementioned PLL control is not performed, but instead a drive source feedback control for maintaining a constant drive speed of the common drive motor 162 is performed.

The drive source feedback control is described with reference to FIG. 8. The common drive motor 162 is equipped with a sensor 172 (first detecting unit) configured to generate a frequency signal (FG signal) in proportion to the drive speed of the motor, using a sensor coil. The FG signal is fed to the drive control unit 200 so that the drive control unit 200 can cause the common drive motor 162 to rotate at a constant speed by performing a drive control based on the FG signal instead of the output signal from the roller encoder 171.

Whether the drive control unit 200 uses the output signal (second detection signal) from the roller encoder 171 or the FG signal (first detection signal) from the common drive motor 162 may be selected by a switch in a driver in the drive control unit 200. For example, the second detection signal or the first detection signal is selected depending on whether the image formation operation mode is the color mode or the monochrome mode.

In accordance with the present embodiment, in the color mode, PLL control is performed using the output signal from the roller encoder 171, so that a constant endless transport speed of the intermediate transfer belt 8 can be maintained highly accurately. Thus, the toner images of the four photosensitive drums 1Y, 1C, 1M, and 1K can be accurately overlapped without color displacement, thus preventing image degradation.

In this case, because a speed variation is caused in the photosensitive drum 1K due to PLL control, some color displacement may be caused between the photosensitive drums 1Y, 1C, and 1M having no color displacement and the photosensitive drum 1K. However, of the speed variation component of the intermediate transfer belt 8, those components having a relatively short period due to the eccentricity in the drive roller 12 or a drive gear engaged with the drive roller 12, or due to the belt thickness variation, can be eliminated by designing the apparatus such that the latent-image-formation-to-transfer time interval corresponds to the period. Thus, the color displacement due to such speed variation components can be eliminated.

Further, the instantaneous speed variation due to the impact of the sheet with the intermediate transfer belt 8, for example, can be reduced by the aforementioned PLL control process, so that no lines of image degradation are caused with respect to the Y, C, or M toner images. Although an instantaneous speed variation may be caused in the photosensitive drum 1K due to the PLL control, possibly resulting in lines of image degradation in a K toner image, such image degradation in the K toner image is minor compared to the image degradation due to color displacement and the like and can be eliminated by another method.

On the other hand, in the monochrome mode, the drive control process is performed using the FG signal from the common drive motor 162, so that the speed of the photosensitive drum 1K does not vary in accordance with the speed variation component of the intermediate transfer belt 8. Therefore, an instantaneous speed variation due to the impact of the sheet with the intermediate transfer belt 8, for example, does not affect the speed of the photosensitive drum 1K. Thus, in the monochrome mode, lines of image degradation due to the instantaneous speed variation in the photosensitive drum 1K can be prevented. In this case, because the speed variation component of the intermediate transfer belt 8 is not cancelled, image stretching or contraction may be caused in a formed monochrome image in accordance with the speed variation of the intermediate transfer belt 8, resulting in some density irregularities.

However, such density irregularities are unavoidable when the belt feedback control is performed whether in the color mode or the monochrome mode, and the image degradation may be considered to be minor compared to lines of image degradation. Therefore, in accordance with the present embodiment, better image quality can be obtained as regards a monochrome image compared to the case where the belt feedback control is performed both in the color mode and the monochrome mode, because of the prevention of lines of image degradation.

However, in accordance with the present embodiment, the printer 100 performs the drive source feedback control instead of the belt feedback control in the monochrome mode, during which the diameter of the drive roller 12 varies as the temperature in the apparatus varies. As a result, the linear speed V (average value of the endless transport speed) of the intermediate transfer belt 8 varies, resulting in a position error in the resultant monochrome image printed on the transfer sheet P in the sub-scan direction or an image stretching or contraction. Thus, in accordance with the present embodiment, the following control is exerted in the monochrome mode.

Control Example 1

Figure 13:
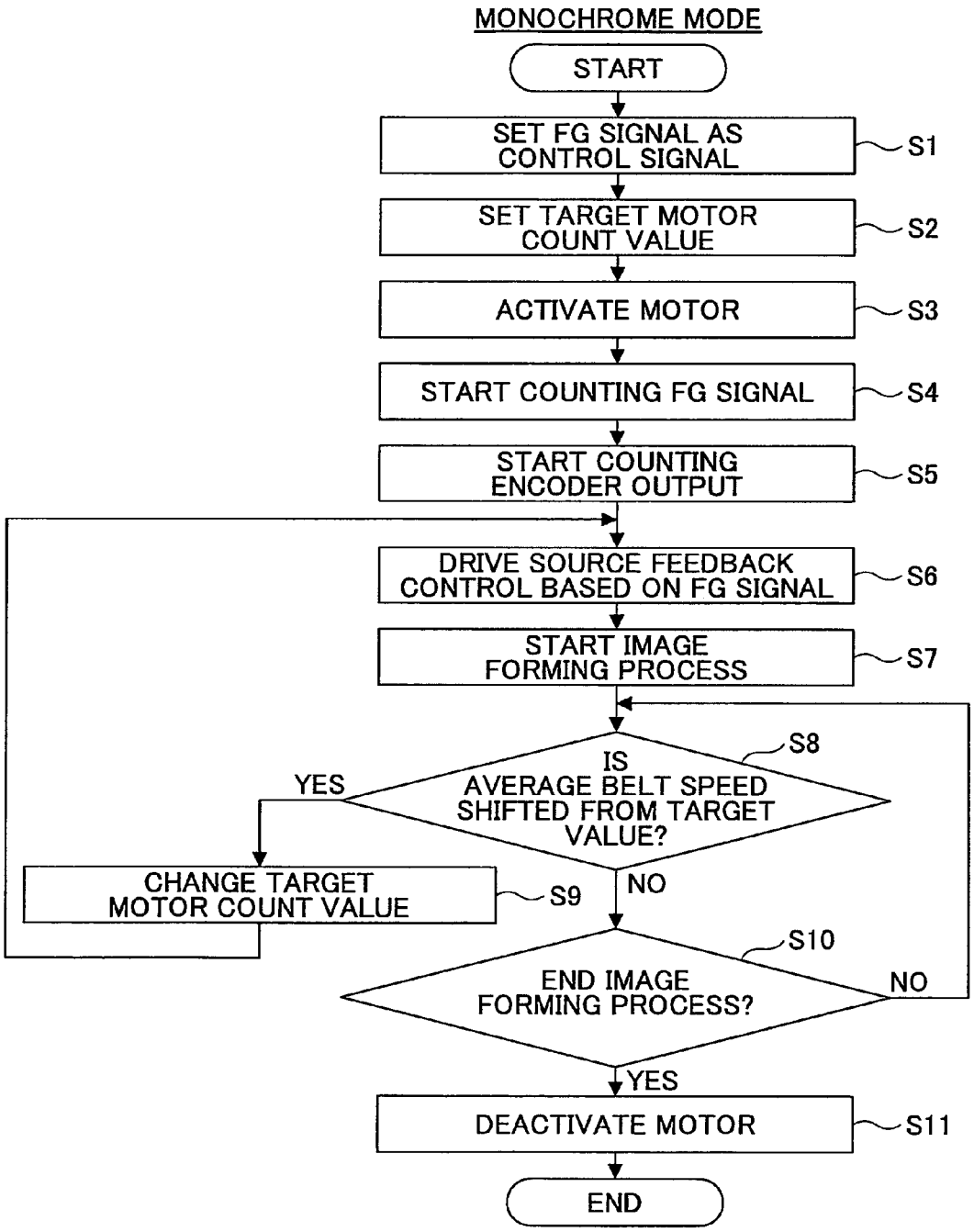
FIG. 13 is a flowchart of a drive control process according to Control Example 1.

FIG. 13 is a flowchart of the drive control operation performed by the drive control unit 200 in the monochrome mode. After a print job is started in the monochrome mode, an FG signal is set as a control signal for the drive control operation (S1). Then, a target count value (target drive speed) of the common drive motor 162 is set (S2). Setting data of the target count value may be stored in a RAM of the drive control unit 200. Thereafter, the common drive motor 162 is driven (S3). Prior to the driving of the common drive motor 162, the movable bracket is moved so that the intermediate transfer belt 8 is spaced apart from the photosensitive drums 1Y, 1C, and 1M. As the common drive motor 162 is driven, FG signals are successively outputted from the sensor 172 for the common drive motor 162 and counted by the drive control unit 200 (S4). The drive control unit 200 is also configured to acquire and count output signals from the roller encoder 171 attached to the axle member of the driven roller 14 for a correcting process as will be described later (S5). Then, the drive control unit 200 performs a drive source feedback control such that the count value of the FG signal whose counting was started in S4 corresponds to the target count value set in S2 (S6) so that the common drive motor 162 can rotate at the target drive speed constantly. Thereafter, an image forming process is started at a predetermined timing (S7).

The drive control unit 200 then determines whether the count value of the output signal from the roller encoder 171 is shifted from the belt target count value that indicates an average value of the target endless transport speed of the intermediate transfer belt 8 (S8). For example, a belt target count value stored in the RAM is read and it is determined whether the count value of the output signal from the roller encoder 171 is within a predetermined range with respect to the count value. If it is determined that the count value is not within the predetermined range (Yes in S8), a correcting process is performed in which the motor target count value of the common drive motor 162 is changed so that the count value of the output signal from the roller encoder 171 approaches the belt target count value (S9). For example, when the count value of the output signal from the roller encoder 171 is below the predetermined range, the motor target count value (reference clock of the motor) is set higher. When the count value of the output signal from the roller encoder 171 is above the predetermined range, the motor target count value is set lower. Preferably, such a setting change is performed at a timing (such as in the interval between image-forming operations, or when the motor is deactivated) such that the change in the speed of the photosensitive drum 1K or the intermediate transfer belt 8 does not affect the obtained image.

The output signal from the roller encoder 171 may contain a speed variation component corresponding to the rotating period of the drive roller, or a speed variation component due to the eccentricity of the encoder or an instantaneous variation component. Therefore, if the correcting process involving the varying of the motor target count value (reference clock of the motor) is performed using the output signal as is, a constant speed of the common drive motor 152 may not be obtained. Thus, if there is the possibility of any of the aforementioned variations, the correcting process may use only a DC component obtained by averaging the speed variation component in the output signal from the roller encoder 171.

When it is determined that the count value of the output signal from the roller encoder 171 is within the predetermined range (No in S8), the driving of the motor is continued, and when the image forming process ends (Yes in S10), the common drive motor 162 is deactivated (S11).

Thus, in accordance with Control Example 1, when the temperature within the apparatus varies and the diameter of the drive roller 12 varies as a result, the change in the speed (average value) of the intermediate transfer belt 8 can be controlled. Thus, in the monochrome mode, the position error of the monochrome image on the transfer sheet P in the sub-scan direction or the overall expansion or contraction of the monochrome image can be prevented.

Control Example 2

Figure 14:
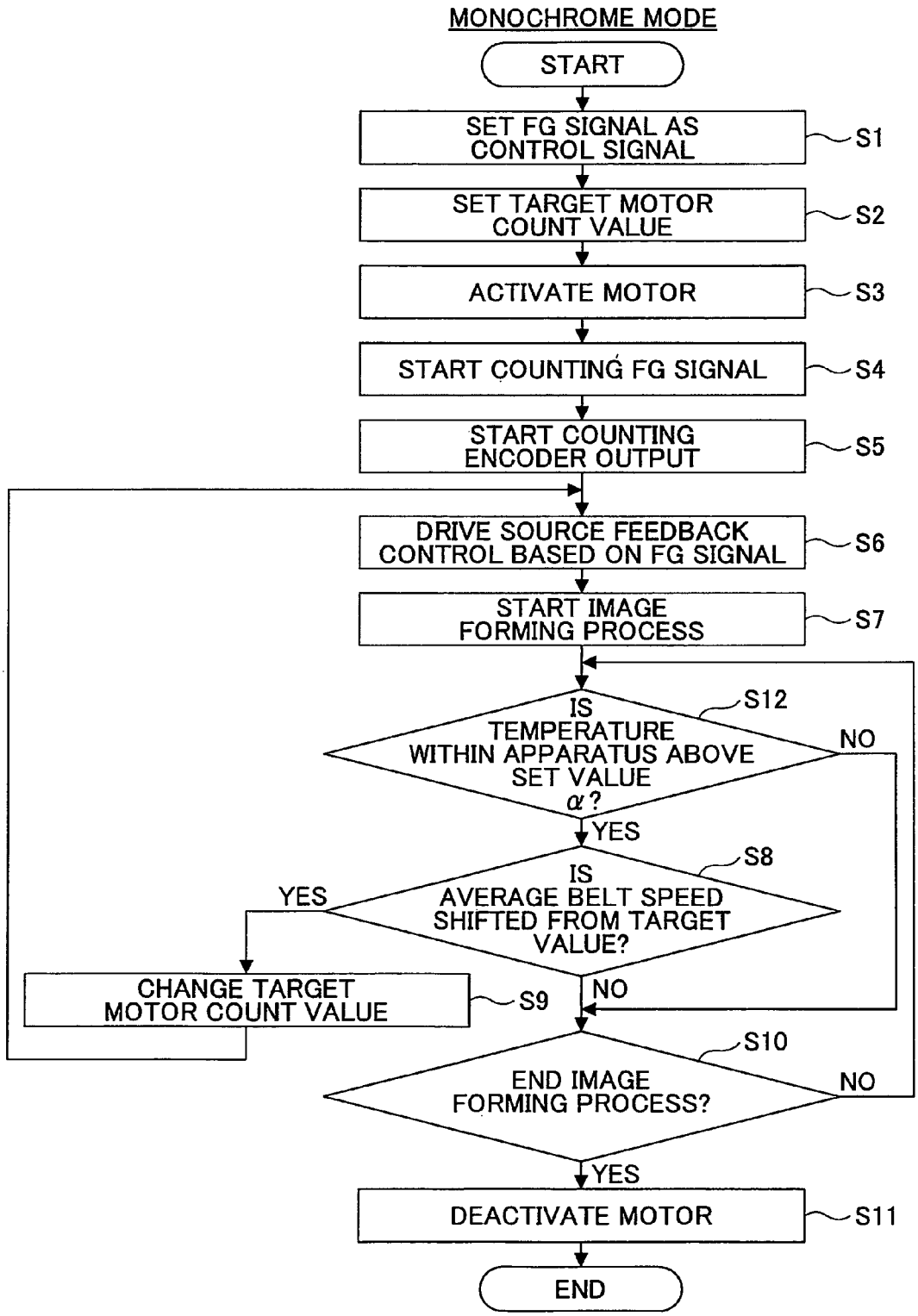
FIG. 14 is a flowchart of a drive control process according to Control Example 2.

FIG. 14 is a flowchart of a control process performed by the drive control unit 200 in the monochrome mode according to Control Example 2. In the above-described Control Example 1, the correcting process involves continuously determining whether the count value of the output signal from the roller encoder 171 is shifted from the belt target count value during the image formation operation. As a result, the drive control unit 200 is subject to a high processing load. Thus, in accordance with Control Example 2, a temperature sensor (temperature detecting unit) is provided in the printer 100, and the correcting process (S8) is performed only when the temperature detected by the temperature sensor exceeds a set value α (Yes in S12). Specifically, an optimum motor target count value for a temperature environment with the set value α or lower may be stored as an initial motor target count value, so that the correcting process (S8) can be performed only when the temperature within the apparatus exceeds the set value α. In this way, the correcting process can be performed only when necessary, thus reducing the processing load.

Control Example 3

Figure 15:
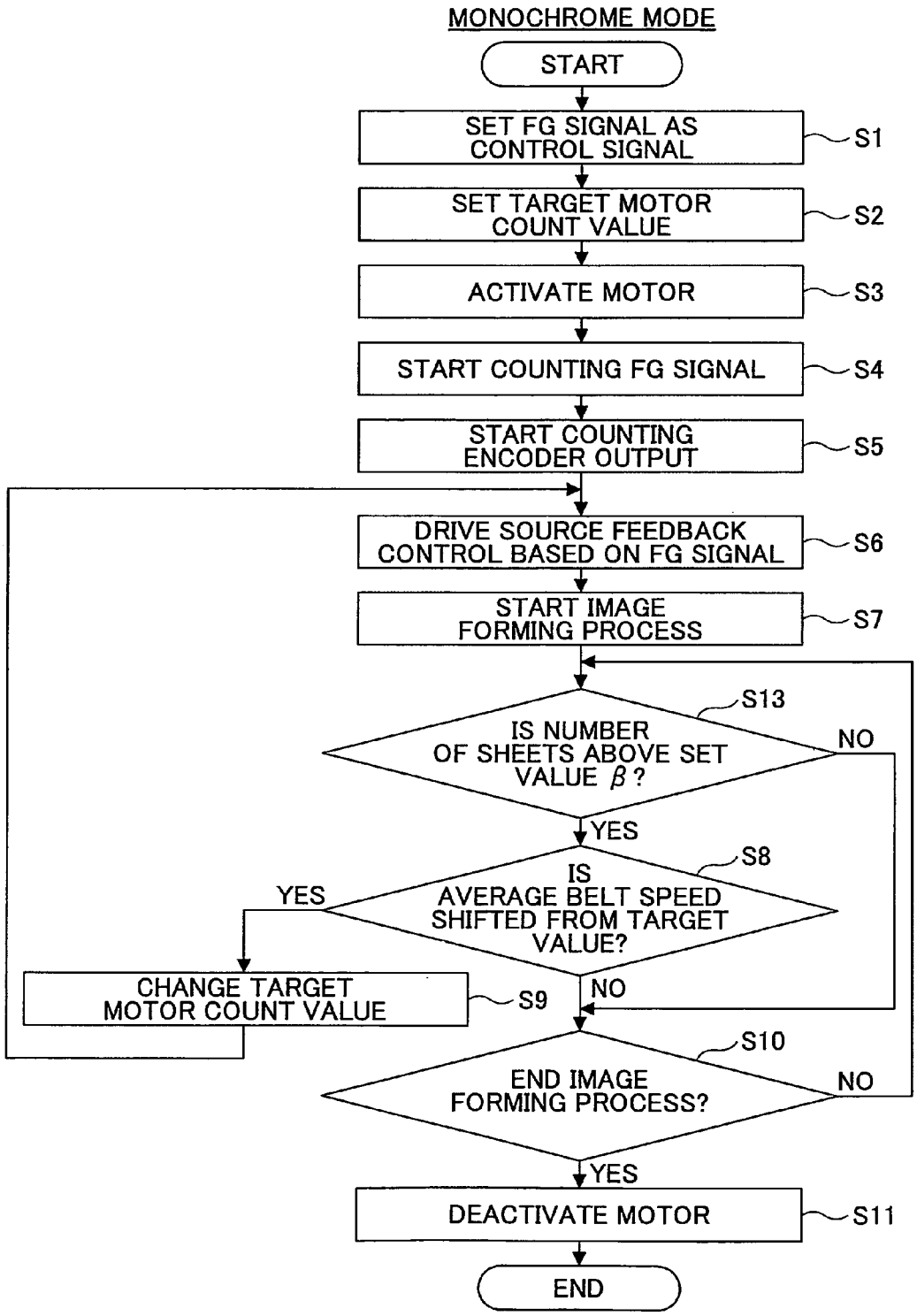
FIG. 15 is a flowchart of a drive control process according to Control Example 3.

FIG. 15 is a flowchart of a drive control process performed by the drive control unit 200 in the monochrome mode according to Control Example 3. In Control Example 2, whether the correcting process is required is determined based on a detection result obtained by the temperature sensor. Because the temperature in the apparatus typically increases sharply during a successive image formation operation, the need for the correcting process can also be determined based on a count value of the number of sheets printed in a successive image formation operation. Thus, in Control Example 3, the correcting process (S8) is performed only when the count value of the number of sheets printed in a successive image formation process exceeds a set value β (Yes in S13). Specifically, an optimum motor target count value for a successive image formation operation in a temperature environment corresponding to a number of sheets less than the set value β may be stored as an initial motor target count value, so that the correcting process (S8) can be performed only when the number of sheets printed exceeds the set value β. In this way, the correcting process can be performed only when necessary, thus reducing the operating burden. Particularly, Control Example 3 enables a further cost reduction as it does not require the temperature sensor as required in Control Example 2.

In the above-described Control Examples 1 through 3, if the output signal from the roller encoder 171 used in the correcting process (S8) exhibits an abnormal value exceeding an upper limit of speed variation that is determined from the estimated expansion or contraction of the diameter of the drive roller 12 in an expected environment, it is likely that the roller encoder 171 is malfunctioning. In such a case, an error process may be performed instead of the correcting process (S8) in order to indicate the encoder malfunctioning on the operating panel, for example. In this way, a user or service personnel can be notified of the need to replace the roller encoder 171. In this case, instead of deactivating the apparatus, the drive source feedback control may be continued using the FG signal without performing the correcting process (S8), so that the image formation process in the monochrome mode can continue. In this case, although the monochrome image quality may be inferior to that in the case where the drive source feedback control process involving the correcting process is performed, the worst case scenario of not being able to form a monochrome image can be avoided.

When the output signal from the roller encoder 171 exhibits an abnormal value, there is the possibility that not only the controlling of the average speed of the intermediate transfer belt 8 in the monochrome mode but also the PLL control (drive control) of the intermediate transfer belt 8 in the color mode cannot be properly performed. Thus, the drive source feedback control based on the FG signal may be provisionally performed by setting the FG signal as the object of control not only in the monochrome mode but also in the color mode. In this case, although the color image quality may be inferior to that in the case where the belt feedback control is performed, the worst-case scenario of not being able to form a color image can be prevented.

Thus, the printer according to the present embodiment includes the four photosensitive drums 1Y, 1C, 1M, and 1K (latent image carriers); the developing units 5Y, 5C, 5M, and 5K (developing units) for developing latent images on the photosensitive drums 1Y, 1C, 1M, and 1K; the intermediate transfer belt 8 (endless belt member) onto which the latent images developed on the respective photosensitive drums 1Y, 1C, 1M, and 1K are successively transferred in an overlapping manner; the drive roller 12 and the common drive motor 162 (drive units) for transmitting a rotating drive force to the intermediate transfer belt 8; the sensor 172 (first detecting unit) for detecting the rotating speed (drive speed) of the common drive motor 162; the roller encoder 171 (second detecting unit) for detecting the endless transport speed of the intermediate transfer belt 8; and the drive control unit 200 (control unit) for controlling the drive speed of the drive unit based on the FG signal (first detection signal) obtained from the sensor 172 or the encoder output (second detection signal) obtained from the roller encoder 171 depending on the image formation operation mode (i.e., selected condition). The drive unit is configured to provide a rotating drive force to the photosensitive drum 1K as well as the intermediate transfer belt 8. When the monochrome mode (FG signal) is selected, the drive control unit 200 performs the correcting process (S8) in which the drive speed controlled by the FG signal is corrected based on the encoder output so that the average value of the endless transport speed of the intermediate transfer belt 8 approaches the target average value. Thus, the variation in the linear speed V (average value of the endless transport speed) of the intermediate transfer belt 8 due to a change in temperature in the apparatus can be prevented by performing the drive source feedback control in the monochrome mode instead of the belt feedback control. In this way, the problem of a printed position error in a monochrome image on the transfer sheet P in the sub-scan direction, or the expansion or contraction of the monochrome image as a whole can be prevented.

In accordance with the present embodiment, the drive unit supplies a rotating drive force to the photosensitive drum 1K alone. In the monochrome mode, in which an image formation operation is performed using only the photosensitive drum 1K, the contacting/separating unit disengages the photosensitive drums 1Y, 1C, and 1M from the intermediate transfer belt 8 while engaging the photosensitive drum 1K with the intermediate transfer belt 8. On the other hand, in the color mode, in which an image formation operation is performed using all of the photosensitive drums 1Y, 1C, 1M, and 1K, the contacting/separating unit engages all of the photosensitive drums 1Y, 1C, 1M, and 1K with the intermediate transfer belt 8.

When the image formation operation is performed in the monochrome mode, the FG signal is selected. When the image formation operation is performed in the color mode, the encoder output is selected for the drive control. Thus, in the color mode, the amount of color displacement can be reduced so that a high-quality color image can be obtained, while in the monochrome mode the lines of image degradation can be prevented.

In Control Example 2, the temperature sensor (temperature detecting unit) detects the temperature in the apparatus. When the temperature detected by the temperature sensor is below the set value α (predetermined temperature), the drive control unit 200 does not perform the correcting process (S8). When the detected temperature exceeds the set value α, the drive control unit 200 performs the correcting process (S8). Thus, the operating burden on the drive control unit 200 can be reduced.

In Control Example 3, the drive control unit 200 performs the correcting process (S8) only in a successive image formation operation where the number of sheets printed exceeds a predetermined number. In this way, the operating burden on the drive control unit 200 can be reduced compared to the case where the correcting process is, performed at all times. In addition, Control Example 3 does not require the temperature sensor as required in Control Example 2, thus enabling a further cost reduction in Control Example 3.

The drive control unit 200 may be configured not to perform the correcting process (S8) when a correction prohibiting condition is met. The correction prohibiting condition may specify that the encoder output exhibit an endless transport speed that exceeds an upper-limit value. When such a condition is met, it is likely that the roller encoder 171 is malfunctioning. Thus, by prohibiting the correcting process (S8) when such a condition is met, i.e., when the encoder output exhibits an abnormal value, the correcting process (S8) can be prevented from being erroneously performed. Preferably, the error process may include the display of an error message when the correction prohibiting condition is met, thus notifying the user or service personnel of the need for replacing the roller encoder 171.

When the encoder output is selected in an image formation operation in the color mode, the drive control unit 200 may be configured to perform a drive source feedback control based on the FG signal instead of the encoder output if the encoder output indicates an endless transport speed that exceeds an upper-limit value. In this case, the resultant image quality may be inferior to that in the case where the belt feedback control is performed, but the worst-case scenario of not being able to form a color image can be avoided.

Preferably, the image forming apparatus includes a gain control unit configured to change a gain set value for the drive unit when an image formation operation is performed in the monochrome mode or the color mode. In the color mode, all four of the photosensitive drums 1Y, 1C, 1M, and 1K are engaged with the intermediate transfer belt 8, so that the intermediate transfer belt 8 is subject to a large drive load. Thus, in the color mode, it is preferable to increase the control gain so that enhanced motor response characteristics can be obtained. On the other hand, in the monochrome mode, only the photosensitive drum 1K is engaged with the intermediate transfer belt 8, and therefore the intermediate transfer belt 8 is subject to less drive load. Thus, the control gain for the color mode, if used in the monochrome mode, may cause vibration of the motor. Thus, the control gain is preferably lower in the monochrome mode than in the color mode so that milder motor response characteristics can be obtained. A resistor that determines the control gain characteristics may be mounted on a motor substrate so that the control gain characteristics can be varied using an electric switch. In the monochrome mode, a control gain may be set such that motor rotation irregularities can be minimized.

The foregoing embodiment has been described with reference to a tandem-type image forming apparatus of the intermediate-transfer type using the intermediate transfer belt 8 (endless belt member). In another embodiment, a tandem-type image forming apparatus of the direct-transfer type may employ a transfer sheet transport belt (endless belt member) configured to support and transport the transfer sheet P (recording material) onto which the toner images developed on the photosensitive drums 1Y, 1C, 1M, and 1K are transferred.

In another embodiment of the present invention, the tandem-type image forming apparatus may include only one photosensitive drum instead of the four photosensitive drums of the foregoing embodiment. Specifically, an image forming apparatus may include a photosensitive drum (latent image carrier) configured to carry a latent image; a developing unit configured to develop the latent image on the photosensitive drum; an intermediate transfer belt 8 (endless belt member) onto a surface of which the latent image developed on the photosensitive drum is transferred, or a transfer sheet transport belt (endless belt member) configured to carry and transport a recording material on which the toner images developed on the photosensitive drums 1Y, 1C, 1M, and 1K are transferred; a drive unit configured to provide a rotating drive force to the endless belt member; a first detecting unit configured to detect a rotating speed of the drive unit when it provides a rotating drive force to the endless belt member; a second detecting unit configured to detect an endless transport speed of the endless belt member; and a control unit configured to perform a drive control operation for controlling the drive speed of the drive unit based on a first detection signal obtained from the first detecting unit or a second detection signal obtained from the second detecting unit depending on a selection condition. The drive unit may be configured to provide the rotating drive force to the photosensitive drum as well as to the endless belt member. The control unit may be configured to perform a correcting process in which, upon selection of the first detection signal in accordance with the selection condition, the drive speed controlled by the first detection signal is corrected using the second detection signal so that an average value of the endless transport speed of the endless belt member approaches a target average value.

Although this invention has been described in detail with reference to certain embodiments, variations and modifications exist within the scope and spirit of the invention as described and defined in the following claims.

The present application is based on Japanese Priority Application No. 2009-192799 filed Aug. 24, 2009, the entire contents of which are hereby incorporated by reference.

What is claimed is:

1. An image forming apparatus, comprising:

plural latent image carriers configured to carry latent images;

plural developing units configured to develop the latent images on the latent image carriers;

an endless belt member;

a drive unit configured to supply a rotating drive force to the endless belt member so as to move the endless belt member in an endless manner;

a first detecting unit configured to detect a rotating speed of the drive unit;

a second detecting unit, provided on a driven unit, configured to detect an endless transport speed variation of the endless belt member due to a diameter change in the drive unit caused by temperature change; and a control unit configured to perform a drive control operation for controlling the rotating speed of the drive unit based on a first detection signal from the first detecting unit or a second detection signal from the second detecting unit selectively depending on a selection condition, wherein the drive unit supplies the rotating drive force to at least one of the plural latent image carriers in addition to the endless belt member, and wherein the control unit is configured to, upon selection of the first detection signal in accordance with the selection condition, correct the rotating speed of the drive unit using the second detection signal such that an average value of the endless transport speed of the endless belt member approaches a target average value.

2. The image forming apparatus according to claim 1, wherein the drive unit is configured to supply the rotating drive force to only one of the latent image carriers, the image forming apparatus further including:

a contacting/separating unit configured to disengage all but the one of the latent image carriers to which the rotating drive force is supplied by the drive unit from the endless belt member in a first operating mode, or engage all of the latent image carriers with the endless belt member in a second operating mode, wherein the first operating mode involves only the latent image carrier to which the rotating drive force is supplied by the drive unit, and the second operating mode involves all of the latent image carriers, wherein the selection condition requires that the first detection signal be selected in the first operating mode and the second detection signal be selected in the second mode.

3. The image forming apparatus according to claim 2, further comprising a gain control unit configured to change a gain set value of the drive unit between the first operating mode and the second operating mode.

4. The image forming apparatus according to claim 1, wherein the latent images developed on the latent image carriers are successively transferred onto a surface of the endless belt member in an overlapped manner.

5. The image forming apparatus according to claim 1, wherein the endless belt member is configured to carry and transport a recording material on which the latent images developed on the latent image carriers are successively transferred.

6. The image forming apparatus according to claim 1, further comprising a temperature detecting unit configured to detect a temperature within the image forming apparatus, wherein the control unit is configured to perform the correcting process only when the temperature detected by the temperature detecting unit exceeds a set temperature.

7. The image forming apparatus according to claim 1, wherein the control unit is configured to perform the correcting process only in the case of a successive image formation operation involving a number of sheets exceeding a set number.

8. The image forming apparatus according to claim 1, wherein the control unit is configured to not perform the correcting process when a correction prohibiting condition is met, the correction prohibiting condition requiring that the second detection signal indicate an endless transport speed that exceeds an upper-limit value.

9. The image forming apparatus according to claim 8, wherein the control unit is configured to perform an error process when the correction prohibiting condition is met.

10. The image forming apparatus according to claim 1, wherein the control unit is configured to perform the drive control operation based on the first detection signal when the second detection signal is selected in accordance with the selection condition when the second detection signal indicates an endless transport speed that exceeds an upper-limit value.

11. An image forming apparatus, comprising:

a latent image carrier configured to carry a latent image;

a developing unit configured to develop the latent image on the latent image carrier;

an endless belt member;

a drive unit configured to supply a rotating drive force to the endless belt member so as to move the endless belt member in an endless manner;

a first detecting unit configured to detect a rotating speed of the drive unit;

a second detecting unit, provided on a driven unit, configured to detect an endless transport speed variation of the endless belt member due to a diameter change in the drive unit caused by temperature change; and a control unit configured to perform a drive control for controlling the rotating speed of the drive unit based on a first detection signal from the first detecting unit or a second detection signal from the second detecting unit selectively depending on a selection condition, wherein the drive unit is configured to supply the rotating drive force to the latent image carrier in addition to the endless belt member, and the control unit is configured to perform a correcting process, upon selection of the first detection signal in accordance with the selection condition, in order to correct the rotating speed of the drive unit using the second detection signal so that an average value of the endless transport speed of the endless belt member approaches a target average value.

12. The image forming apparatus according to claim 11, wherein the latent image developed on the latent image carriers is transferred onto a surface of the endless belt member.

13. The image forming apparatus according to claim 11, wherein the endless belt member is configured to carry and transport a recording material on which the latent image developed on the latent image carriers transferred.

14. The image forming apparatus according to claim 1, wherein the second detecting unit detects a rotary angular speed of the driven unit.

15. The image forming apparatus according to claim 1, wherein the second detecting unit detects a rotary angular displacement of the driven unit.

16. The image forming apparatus according to claim 11, wherein the second detecting unit detects a rotary angular speed of the driven unit.

17. The image forming apparatus according to claim 11, wherein the second detecting unit detects a rotary angular speed.

18. The image forming apparatus according to claim 1, wherein the first detecting unit generates a frequency signal in proportion to the rotating speed of the driven unit.

19. The image forming apparatus according to claim 11, wherein the first detecting unit generates a frequency signal in proportion to the rotating speed of the driven unit.

* * * * *